US009912072B1

(12) United States Patent
Mandeville et al.

(10) Patent No.: US 9,912,072 B1
(45) Date of Patent: Mar. 6, 2018

(54) RF MODULE WITH INTEGRATED WAVEGUIDE AND ATTACHED ANTENNA ELEMENTS AND METHOD FOR FABRICATION

(71) Applicant: Lockheed Martin Corporation, Bethesda, MD (US)

(72) Inventors: Andrew R. Mandeville, Delran, NJ (US); Daniel W. Harris, Mt. Laurel, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 140 days.

(21) Appl. No.: 14/622,558

(22) Filed: Feb. 13, 2015

Related U.S. Application Data

(60) Provisional application No. 61/955,026, filed on Mar. 18, 2014.

(51) Int. Cl.
*H01Q 1/06* (2006.01)
*H01Q 21/00* (2006.01)

(52) U.S. Cl.
CPC ..... *H01Q 21/0006* (2013.01); *H01Q 21/0075* (2013.01); *H01Q 21/0087* (2013.01)

(58) Field of Classification Search
CPC ..... H01Q 21/0006; H01Q 21/0075; H01Q 21/0087
See application file for complete search history.

(56) References Cited

U.S. PATENT DOCUMENTS 6,650,291 B1 * 11/2003 West ..... H01Q 3/46 342/371
2011/0057852 A1 * 3/2011 Holland ..... H01Q 9/28 343/795
2012/0022622 A1 * 1/2012 Johnson ..... A61N 5/04 607/101
2013/0314182 A1 * 11/2013 Takeda ..... H01P 3/16 333/24 R

OTHER PUBLICATIONS

T. Waterman, S. Geibel, S. Quade, V. Sanchez, M. Cooley, "Planar-Fed Stepped and Folded Notch Radiators: Novel Enabling Technologoies for Wideband Multi-Function AESAs", Distribution to the U.S. Government and their Contractors from Northrup Grumman Corp., Jun. 2011.

SS. Holland, D.H. Schaubert, M.N. Vouvakis "A 7-21 GHz Dual-Polarized Ultrawideband Modular Antenna", IEEE Transactions on Antennas and Propagation, 2012, vol. 60, No. 10, pp. 4589-4600.

* cited by examiner

*Primary Examiner* — Hoang Nguyen
*Assistant Examiner* — Jae Kim
(74) *Attorney, Agent, or Firm* — Howard IP Law Group

(57) ABSTRACT

A radio frequency (RF) module may comprise: (a) a substrate including a plurality of integral waveguides formed therein, each of the plurality of waveguides orthogonally-oriented with respect to the one or more adjacent waveguides; and (b) a plurality of antenna radiator elements attached to the dielectric substrate and oriented such that a pair of antenna radiator elements is electrically coupled to each waveguide. Each of the integral waveguides is electrically coupled to electrical circuitry of the RF module.

20 Claims, 18 Drawing Sheets

Implementation of Twisted Ridge Waveguide in Multi-Layer HTCC Substrate (HFSS Model)

Tx Module Concept with
Integrated Radiating Element

Legacy Radiating Element
Assembled to Ground Plate

Implementation of Twisted Ridge Waveguide in Multi-Layer HTCC Substrate (HFSS Model)

Description of Twisted Ridge Waveguide

Straight Section of Waveguide

Typical Implementation of a
Twisted Waveguide within a
Multi-Layer Substrate

15° Waveguide Rotation

30° Waveguide Rotation

45° Waveguide Rotation
at the End of Module

Gradually Rotated Waveguide

Waveguide with fixed 45° Rotation

RF MODULE WITH INTEGRATED WAVEGUIDE AND ATTACHED ANTENNA ELEMENTS AND METHOD FOR FABRICATION

CROSS-REFERENCE TO RELATED APPLICATIONS

This application claims priority to and benefit of U.S. Provisional Patent Application No. 61/955,026, filed Mar. 18, 2014 and entitled "RF MODULE WITH INTEGRATED WAVEGUIDE AND ATTACHED ANTENNA ELEMENTS AND METHOD FOR FABRICATION," the entire disclosure of which is hereby incorporated by reference herein for all purposes.

FIELD OF THE INVENTION

The present invention relates to the field of microwave antenna arrays.

SUMMARY

As the frequency of operation of radar antennas increases, the spacing between the radiating elements that make up the aperture becomes smaller. For example, the spacing may be less than 1.0 centimeter (cm) (or 0.400") center-to-center at 16 GHz (Ku band). In millimeter wave arrays, the spacing may be on the order of 0.11" center-to-center. In addition, effective phased array radars can have 10,000 or more radiating elements. The radiating elements in these millimeter wave radar assemblies have critical alignment requirements. They require isolation between adjacent radiating elements and excellent grounding. In addition, the radiating elements in millimeter wave radar assemblies require thermal management due to their high power generation in small effective areas.

Vivaldi (also known as notch or tapered-slot) antenna elements are commonly used for applications that require broad-bandwidth, wide scan volumes, and polarization diverse operation. Such elements are typically produced for implementation in a high-quality, high frequency dielectric substrate printed circuit board ("PCB") laminate material (e.g. an RT/Duroid® laminate commonly used PCB material, or equivalent) with solder attached coaxial connectors and support posts where elements intersect to form an "egg crate" configuration with the assembly soldered together on a common ground plane. The elements are typically interfaced to the next higher assembly using RF connectors. These connectors become increasingly smaller, more fragile, and more expensive with higher frequency operation. Furthermore, for proper electrical performance, each element in the array must be electrically connected to the adjacent elements, which connections may be difficult in smaller and more fragile structures.

While Vivaldi elements typically have superior performance, they pose a number of significant mechanical and producibility challenges. Each element in the array must be connectorized; this leads to increased material cost, assembly labor, producibility risk and RF loss associated with the connections made with the connectors. Each element in the array must be electrically connected; this leads to difficulty in assembling and reworking such arrays since all of the elements are soldered to a common ground plane. Extremely tight tolerances are required, particularly at mmW (millimeter wave) frequencies, to insure mating connectors are properly aligned to prevent damage and provide adequate RF performance. The associated cost and risk of Vivaldi elements makes them unsuitable for high volume production.

In one technique, mechanical attachment between adjacent radiating elements is formed in a phased array aperture with epoxy joints and machined features in soft-substrates such as substrates made from laminate material. Materials such as polytetrafluoroethylene (PTFE) and laminate material substrates (PTFE/glass or PTFE/ceramic composites) exhibit poor dimensional stability, cold flow characteristics, and undesirable deformation under cutting stresses. Unlike metals, features machined in these materials cannot be relied upon to provide the positional alignment required in a high/wide band phased array aperture. Therefore to achieve element-to-element alignment and orientation, radiating elements are assembled using complicated tooling and requiring tedious fabrication procedures. Furthermore, laminate material substrates also have poor thermal characteristics and may require active cooling to prevent damage during operation.

Another technique uses screws to fasten radiating elements to a substrate. However, due at least in part to the minute structural requirements (e.g., 0.11 inches center-to-center distance between elements) and precise electrical and structural tolerance requirements for millimeter wave antenna structures, such an approach is not feasible.

As noted, another technique uses an "egg crate" or "interlocking comb" configuration of Vivaldi elements fabricated onto a thin strip of a microwave dielectric substrate such as a laminate material substrate to form arrays. In this technique, each Vivaldi element is connectorized, and electrical connectivity between adjacent elements is implemented with a solder joint. This method provides good electrical performance, but is very difficult to assemble. As frequency increases, the element size decreases and tighter tolerances are required to assemble an egg crate array. Such tolerances become impractical at millimeter wave frequencies, which have small lattice spacings and tight tolerances. Furthermore, this technique requires significant hand assembly and rework As a result, such array fabrication process does not lend itself to large quantity production. Once assembled, the entire antenna must be reflowed simultaneously, making any defects difficult to correct, which can result in significant variability in the quality of the interconnection between elements. In addition, the antenna is subject to warpage because of thermal expansion differences between the radiators and the array ground plane.

While efforts have been made to make improved Vivaldi elements, all of those efforts still require the elements to be electrically connected via a connector attached to the element. For example, folded notch and stepped notch elements have been developed, but these elements still require a coaxial connector, and also still require the use of a lossy balun circuit. A broadband element of planar coupled dipoles has also been developed, however it still requires the use of a coaxial connector or a fuzz-button connector, the fuzz-button connector being difficult to fabricate at millimeter-wave frequencies.

The identified techniques require the use of an RF connector to interface to a TR module in a column assembly. The RF connection adds significant expense and mechanical risk, as well as introducing additional front end losses. In a typical array assembly a coaxial interconnection would consist of three parts: the connector on the element, a connector on the module, and a bullet for connecting the connector on the element to the connector on the module. Each of these components adds significant cost to the array.

The coaxial connection also introduces a high degree of mechanical risk. In order to attach the array to the next higher assembly, multiple RF connections must be made simultaneously, which introduces significant risk. Even small misalignments in the connection can result in significant RF losses, and must be avoided.

Additional difficulty is encountered when attempting to design a broadband, dual-polarized phased array antenna element. Both broadband and dual-polarized elements present significant design challenges. Broadband elements typically rely on mutual coupling in order to achieve the required bandwidth. In order to ensure resonance free coupling between elements, broadband radiators are typically in very close proximity to each other or are electrically connected. Any gaps between elements would either need to be bridged with a conductive material or minimized in order to maximize coupling and avoid gap-induced resonances. A module-integrated element would, by necessity, be electrically separated by a gap from the elements on the adjacent module, which makes its implementation difficult. Dual-polarization requires having radiating elements in two orthogonal dimensions, which makes it difficult to fit a dual-polarized element onto a module. Additionally, the need to have independent feeds for two polarizations further complicates the design. Typically, dual-polarized elements are fed with coaxial connectors, which, as noted, are undesirable because they increase the cost of the design, add electrical loss, and increase design risk. At millimeter-wave frequencies, very small connectors must be used in order to fit on the array lattice, which compounds the problems described. Because of these challenges, the radiating element cost often comprises a large portion of the overall array cost.

According to aspect of the invention, there is disclosed an array structure and method of making a broadband, dual-polarized phased array antenna.

In one embodiment, a modular machined Vivaldi-notch radiating element is fed with a substrate-integrated waveguide, which exhibits significant improvements in cost, loss, and producibility over previous Vivaldi element designs.

As aspect of the invention described herein may be embodied as a machined dual-polarized Vivaldi-notch radiator, which includes antenna elements attached onto the edge of an RF module. This design has a number of beneficial features. Because the antenna element feed is fully integrated onto the module, no coaxial connectors are necessary, eliminating the associated cost, loss, and mechanical risk associated therewith. The antenna element feed is integrated directly into the RF module substrate (i.e., embedded within), and is produced using standard techniques for printed circuit fabrication. Such a feed is coplanar with the module, and is lower loss than the feed of a comparable conventional antenna element. The individual antenna elements are less-expensive to machine than a G3P0 or equivalent connector, and can be attached to the substrate with less difficulty, such as by brazing or other attachment method for coupling/connecting antenna elements. Electrical connectivity between antenna elements is achieved using EMI gaskets, which allows for the element to be incorporated directly on to an RF module. In an embodiment the antenna elements are machined and exhibit lower loss and have comparable scan performance and bandwidth to existing laminate substrate antenna elements.

An embodiment of the invention may comprise a machined radiating element braze-attached to a high-temperature, co-fired ceramic (HTCC) layer of an RF module. The ceramic layer may contain orthogonal substrate-integrated waveguide feeds. The radiating element may be a dual-polarized Vivaldi-notch antenna, which may be directly attached to an RF module such as a transmit/receive (TR) module through a braze joint along the module edge. A Vivaldi element having two parallel conductive surfaces operate as a slotline transmission line. The slotline is made to radiate by exponentially increasing the gap between the two conductors resulting a flared notch. The radiated energy is polarized across the slotline gap. A dual-polarized element is created by arranging two Vivaldi elements orthogonally with respect to their polarization axes. In embodiments of the invention, the Vivaldi elements may be created from metallic parts, which are machined to provide the proper exponential flaring. Each part may comprise one half of a dual-polarized element; the gap between the parts creates the slotline. The machined pieces may be arranged along the edge of a module to form a linear array of dual-polarized elements. In an embodiment, the elements may be brazed to the plated edge of the HTCC module. The plated surface around the element feed-point is cut away to allow energy to couple between the element and a dielectrically-loaded waveguide feed, which is integrated into the HTCC module substrate.

The waveguide feed in the ceramic (or other high dielectric constant) substrate layer provides a connectorless method to feed the Vivaldi elements. Typically, Vivaldi elements are fed with microstrip or stripline transmission lines. A balun circuit is typically required to couple energy from the feed-line to the slotline on the element. The balun circuit complicates the element feed and makes it difficult to integrate the element onto a module. In present embodiments of the invention, the propagating mode of the waveguide couples directly to the slotline mode on the antenna element, eliminating the need for a balun circuit. The waveguide may be fabricated in the module substrate using standard printed circuit techniques. The walls of the waveguide may be implemented using vias and ground plane layers, and no special tooling is required. In an embodiment the module substrate has a high dielectric constant, and as a result the waveguide is dielectrically loaded, and its cutoff frequency is lowered. This is advantageous as it results in a smaller waveguide that is able to fit inside the element lattice spacing. In an embodiment, a ridged waveguide is utilized, which further lowers its cutoff frequency and increases the waveguide bandwidth. In an embodiment, corners of the waveguide may be clipped at non-right angles and the ridges are arranged such that the waveguide fits within the footprint of the module. The waveguide connects to the module circuitry through simple microstrip transition, and has minimal mismatch loss.

In an embodiment, the RF modules with the integrated waveguides and attached antenna elements are assembled into the next higher assembly to form an active planar phased array. Electrical connectivity between adjacent RF modules and elements is important to maintaining proper electrical performance. Element connectivity may be achieved using EMI gaskets, which bridge gaps between conductive surfaces. Connectivity between the elements themselves may be achieved using a compressible foam or spiral shielding material, while ground plane connectivity between separate RF modules may be achieved using conductive spring-finger gaskets between the RF modules. The use of gaskets to achieve electrical continuity allows for the RF modules to be easily inserted or removed from the array, resulting in full maintainability of the array. A radio frequency (RF) absorber may be used in place of the foam gasket between elements, at the expense of ohmic efficiency at high scan angles.

DETAILED DESCRIPTION

Figure 1A:
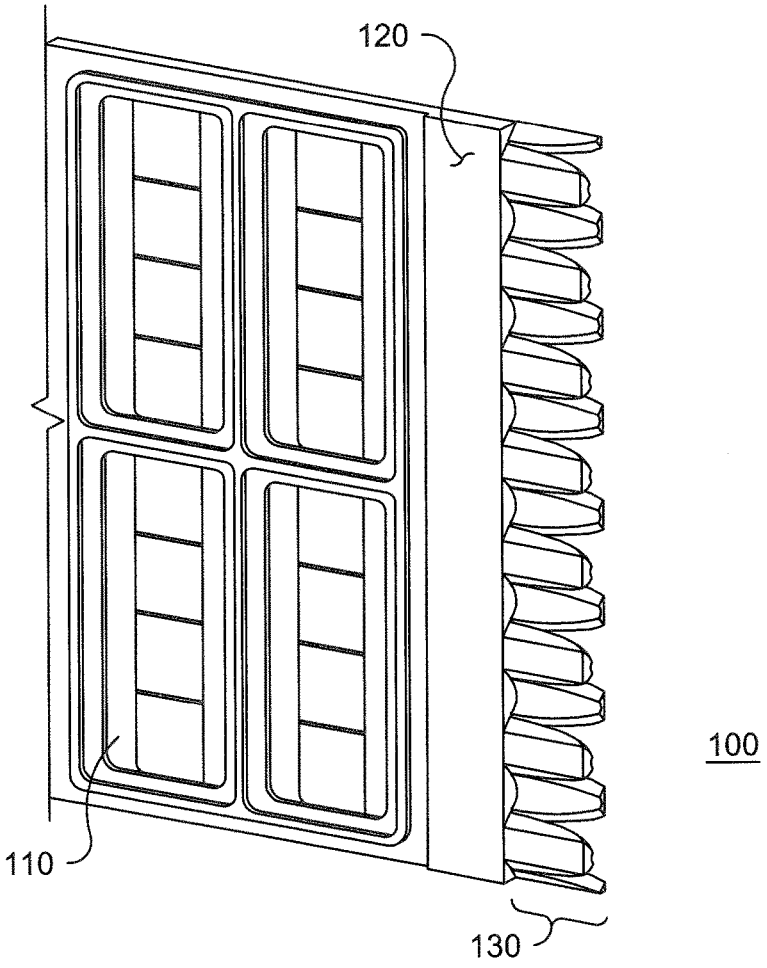
FIG. 1A is an isometric view of an exemplary RF module with a substrate including an integrated waveguide and attached antenna elements.

This description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1A is an isometric view of an exemplary radio frequency (RF) module 100 for a microwave antenna array assembly with electronics section or portion 110, substrate 120, and antenna elements 130. RF module 100 may be a portion of a larger array suitable for use in a wide-band phased array radar system, with a plurality of RF modules arranged next to each other to form the antenna array. In embodiments, the RF module may be a transmit receive (TR), a transmit module, a receive module, or any type of passive module for transmitting or receiving an RF signal. The electronics 110 of the exemplary RF module 100 will accordingly have the appropriate type of electronic for the type of RF module. Substrate 120 is typically an integral part of the RF module 100 and provides a cover at the end of the electronics section for the electronics within the module, although in embodiments a separate substrate may be attached to an end of the electronics section 110. As will be explained, the substrate 120 may contain integral waveguides that are electrically coupled to the electronics of the electronics section 110 and the antenna elements 130, thereby carrying signals to and from the antenna elements 130. The antenna elements 130 are attached to the substrate 120 so that they are electrically coupled to the waveguides in the substrate 120. In an embodiment, each of the antenna elements may be a "horn" that comprises a half of a radiating element, and therefore two half-elements form a single radiating element. As used herein, the term "antenna element" may refer to a single-half element or a plurality of half-elements.

Figure 1B:
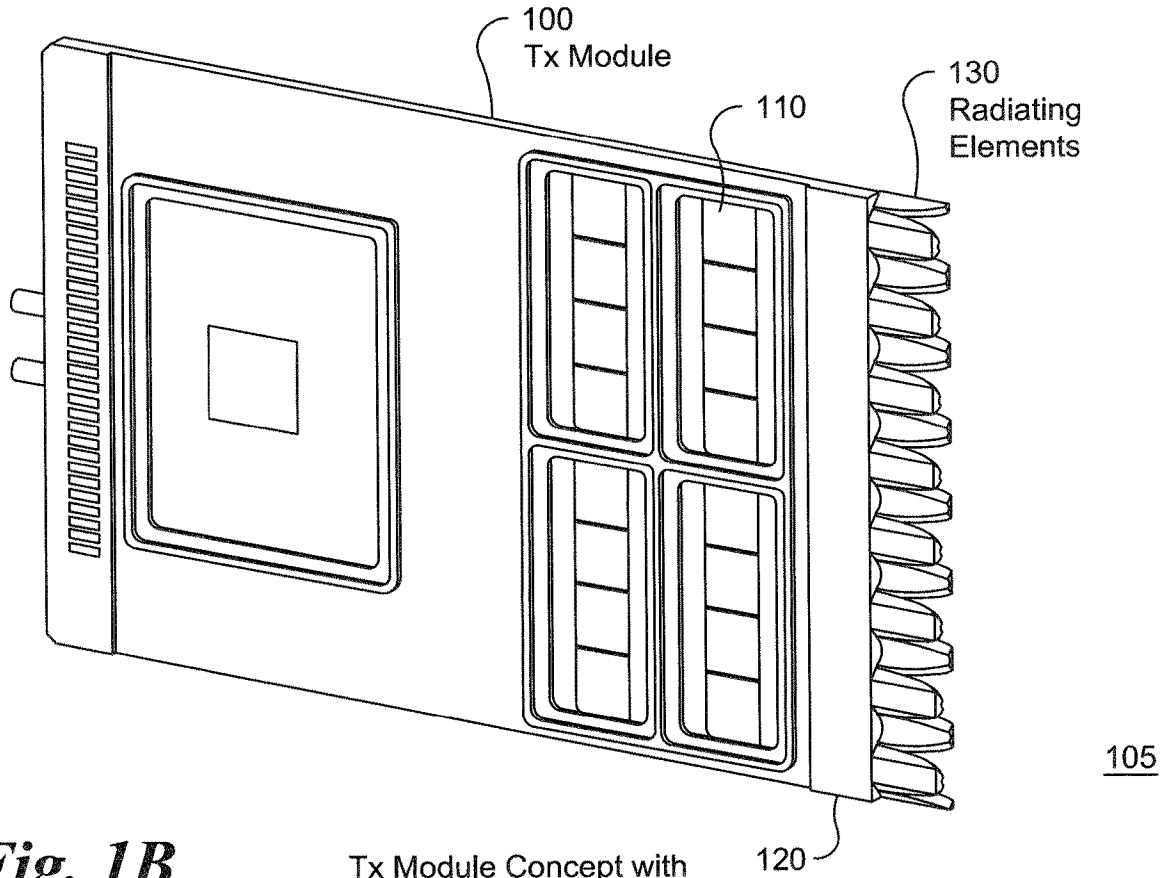
FIG. 1B is an isometric view of an exemplary RF transmit module with a substrate including an integrated waveguide and attached antenna elements.

FIG. 1B is an isometric view of an exemplary radio frequency (RF) module 105 for a microwave antenna array assembly with electronics section 110, substrate 120, and antenna elements 130. RF module 105 is configured similarly to the RF module of FIG. 1A, except that RF module 105 depicts connectors that may be on an opposite end of the RF package to the antenna elements. As will be understood, the connectors allow the RF module 105 to be connected to an electronics system. Typically, the connectors at the end of the RF module are larger than the connectors that would be necessary on connectorized antenna elements on the antenna array because they are not subject to the space limitations of the connectors on the antenna array.

The RF modules 100 and 105 with attached antenna elements 130 and substrate 120 that provide the electrical coupling between the electronics section 110 and the antenna elements 130 represent a major departure from the current state of the art. This arrangement is advantageous because it is connectorless, and therefore avoids the mechanical problems associated with conventional connector designs as well as the electrical losses associated with such connector designs. Furthermore, in the implementation of the RF module 200 shown in FIG. 2, waveguides 210 and 220 are orthogonal to one another, which permits the implementation of a connector-less antenna array with dual-polarized radiating elements within a small footprint that is smaller than current designs.

Connectorless, Non-Laminate, Radiating Elements

Figure 2:
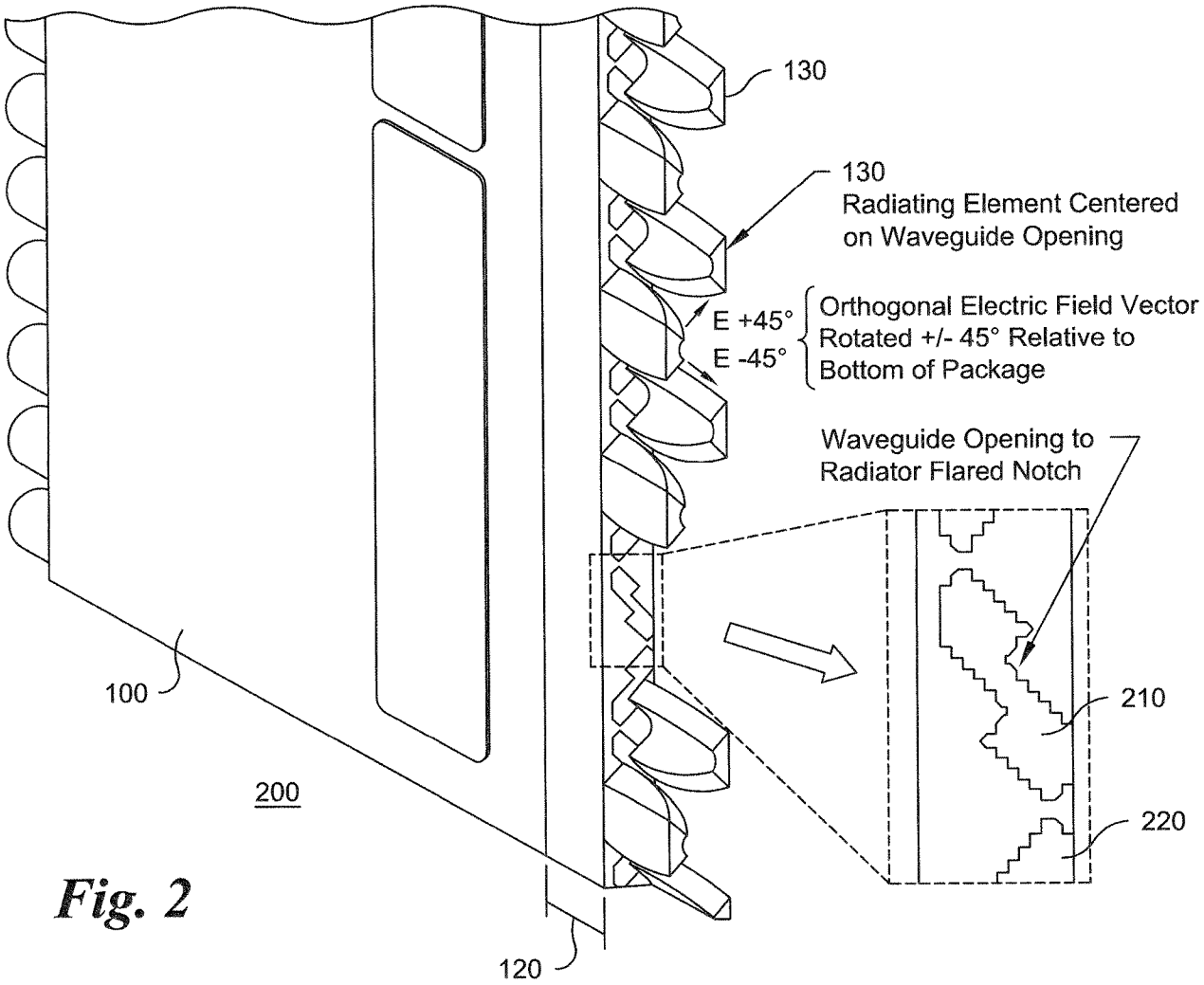
FIG. 2 is an isometric view of an exemplary RF transmit module with a substrate with an antenna element removed to show the integrated waveguide.
Figure 3:
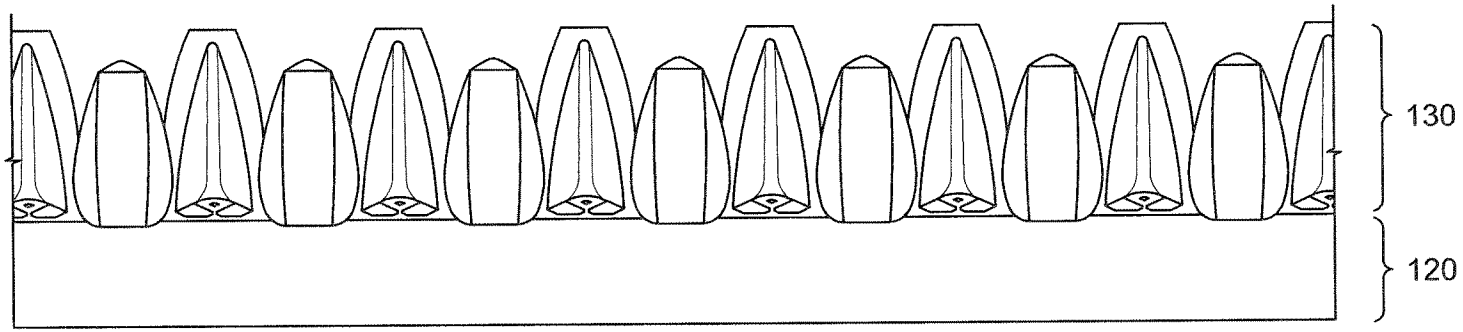
FIG. 3 is an elevation view of antenna elements on an RF substrate.
Figure 4:
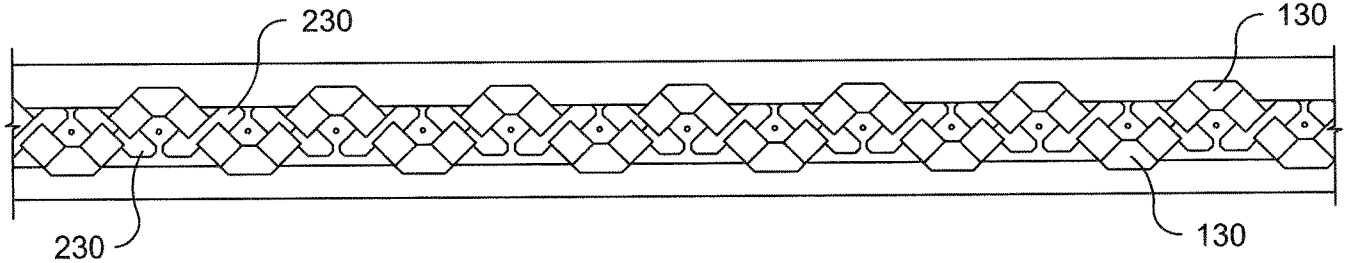
FIG. 4 is a top plan view of antenna elements on an RF substrate.

In an embodiment, the radiating element concept for the RF module is dual-polarized Vivaldi-notch antenna elements that are machined or otherwise formed, and then attached directly to the edge of the RF module such as a transmit/receive (TR) module through a braze joint along the module edge. FIG. 2 shows an isometric view of an RF module with one antenna element removed to show the orthogonal relationship between waveguides 210 and 220. FIG. 3 shows an elevation view of the antenna elements 130 attached to the substrate 120, while FIG. 4 shows a plan view of the antenna elements 130 attached to the substrate 120, and also shows the orthogonal relationship between the waveguides 230 integrated into the substrate.

Figure 5:
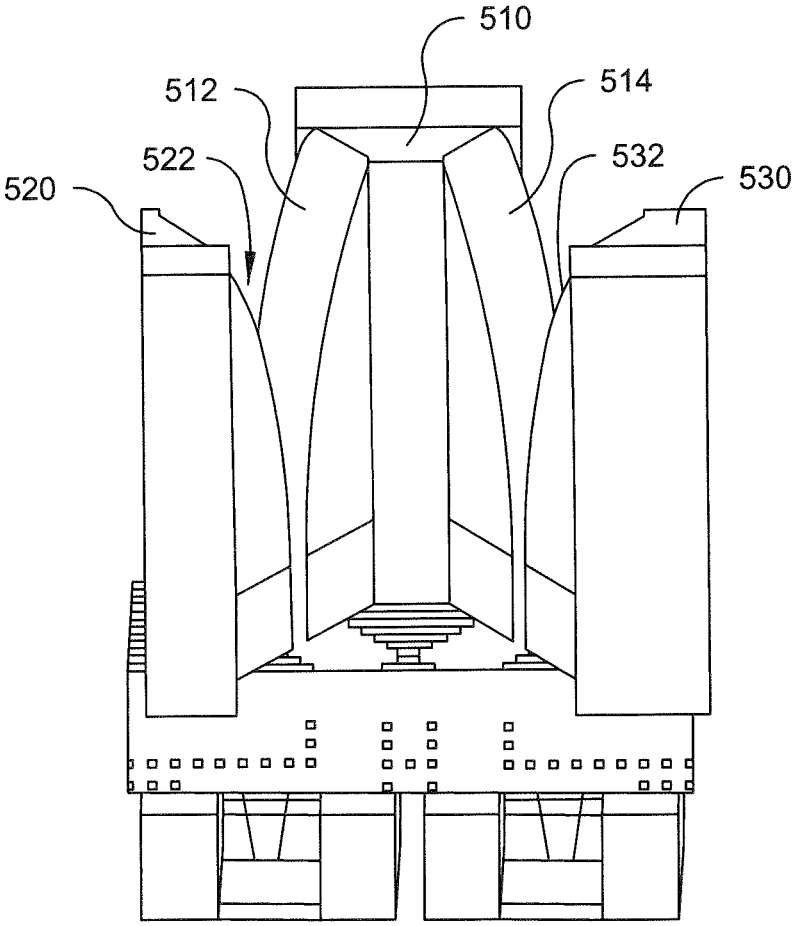
FIG. 5 is an isometric view of a radiating element formed by two antenna elements.
Figure 6:
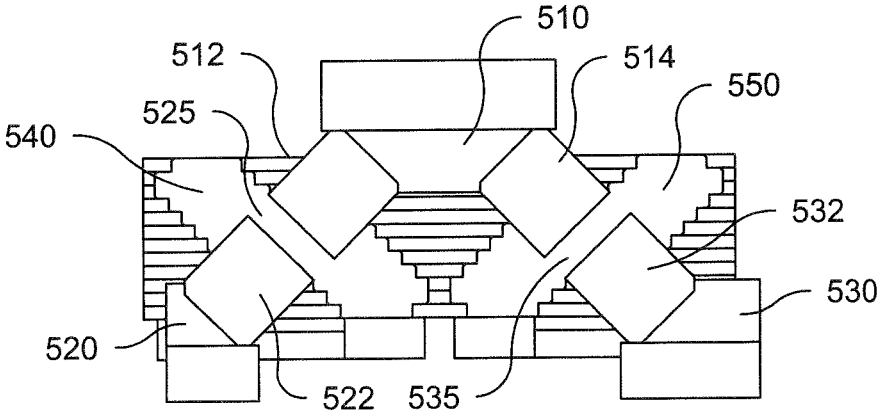
FIG. 6 is a plan view of the radiating element formed by two antenna elements of FIG. 5.

As will be understood, Vivaldi elements consist of two parallel conductive surfaces which operate as a slotline transmission line. The slotline is made to radiate by exponentially increasing the gap between the two conductors resulting a flared notch. The radiated energy is polarized across the slotline gap; a dual-polarized element is created by arranging two Vivaldi elements orthogonally with respect to their polarization axes. FIG. 5 is an isometric view of an antenna element 510 and two adjacent antenna elements 520 and 530. Flared edge 512 of antenna element 510 forms a radiating element with flared edge 522 of antenna element 520. Similarly, flared edge 514 of antenna element 510 forms a radiating element with flared edge 532 of antenna element 530. FIG. 6 shows a top plan view of antenna elements 510, 520, and 530 and the radiating elements formed by the flared edges of those elements. FIG. 6 also shows orthogonal waveguides 540 and 550, which are integrated into the substrate to which the antenna elements 510, 520, and 530 are attached. As shown, the antenna elements are positioned so the flared edges are centered on the openings on waveguides 540 and 550 to couple the radiator formed by flared edge 512 and 514 with waveguide 540 and antenna elements to the waveguides and form the radiating elements.

In an embodiment, the antenna elements may be created from a high conductivity metal with substantially uniform expansion properties, such as a vacuum melted, low expansion, iron-nickel-cobalt alloy, which may be machined to provide the proper exponential flaring and which is capable of withstanding the temperatures present in an antenna array application. By way of non-limiting example, it has been observed that iron-nickel-cobalt alloys with approximately 29% nickel, 17% cobalt, less than 0.01% carbon, 0.2% silicon, 0.3% manganese, and the balance in iron, may have a density of 8359 kg/cu-m, a thermal conductivity of 17.3 W/m-K, a melting point of approximately 1450 degrees Celsius, and relatively uniform thermal expansion coefficients $10^{-6}$/° C. of approximately 5.2 at 25-200° C., 5.1 at 25-300° C., 5.1 at 25-400° C., 6.2 at 25-500° C., 7.8 at 25-600° C., 9.1 at 25-700° C., 10.3 at 25-800° C., and 11.3 at 25-900° C. The foregoing iron-nickel-cobalt alloy has been observed to meet the high temperature requirements and low expansion properties needed for an antenna array application, however other metallic alloys may be used that are able to meet the temperature requirements and expansion properties needed for a particular antenna array application. Each element comprises one half of a dual-polarized radiating element; the gap between the parts creates the slotline. The machined pieces may be arranged along the edge of a module to form a linear array of dual-polarized elements. The machined pieces may be brazed to the plated edge of the HTCC module. The plated surface around the element feed-point is cut away to allow energy to couple between the element and a dielectrically-loaded waveguide feed, which is integrated into the HTCC module substrate. The braze technology used has been employed to attach coaxial connector shrouds and pins. In other embodiments, the antenna elements may be may from other metals compatible with the brazing process, such as copper.

In other embodiments, the antenna elements do not have to be a machinable alloy. The antenna elements may be formed, cast, or 3D printed rather than machined, and could still be brazed or otherwise attached (such as by an adhesive) onto the substrate. In another embodiment, the element may be made from a metalized plastic, and may be attached to the substrate by an adhesive such as an epoxy.

Figure 1C:
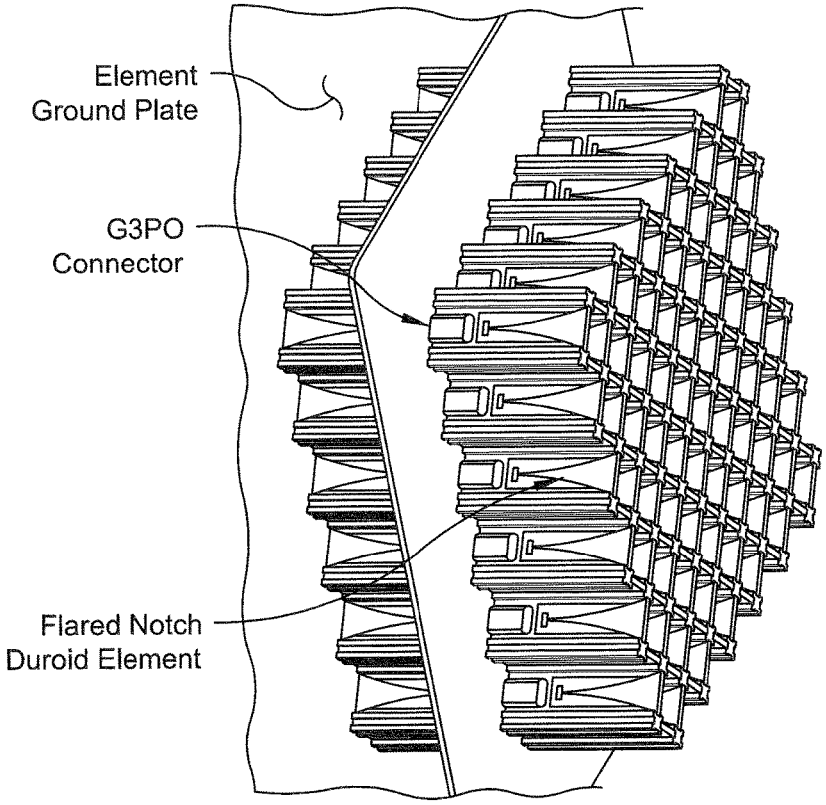
Fig. 1C (Prior Art)
FIG. 1C is an isometric view of a prior art antenna array using dielectric substrate elements.

Regardless of the antenna element material, the "horn" design avoids many of the drawbacks of the prior art. As discussed, the prior art typically teaches antenna elements formed on a printed-circuit board laminate material in which the antenna radiating element is coupled to the RF module using connectors, such as shown in FIG. 1C. In the radiating element of FIG. 1C, the legacy radiating element is assembled to a ground plate which is installed in the antenna structure. The transmit and receive modules are plugged into connectors of the radiating elements. The module with the integrated radiating element protrudes through an opening in the antenna structure, and the modules need to be grounded to each other and the structure faceplate. In the prior art designs, the connectors become increasingly smaller, such as in millimeter wave antenna arrays where the spacing between antenna elements is on the order of 0.11", which necessitates connectors smaller than that spacing, on the order of a pinhead. In contrast, in the embodiments of the claimed invention, there are no connectors to cause mechanical issues or electrical losses—the transmit and receive modules with integrated elements eliminate the connectors. In the invention described herein the element is brazed onto the module in place of the coaxial connection. Because the base of the element has a much larger surface area than that of pinhead-sized connector, it is easier to braze on the element than a connector. While a misalignment of the element would result in degraded performance, the tolerances with which it must be brazed are comparable to those required to braze a connector. Finally, the electrical loss associated with coaxial connector is eliminated.

Significantly, machined antenna element horns can be produced at a significantly lower cost than connectorized antenna elements. The antenna elements are machined using standard techniques, and the cost of the entire element will be on par with that of a single microwave connector. Additionally, the technique used to braze the elements onto the modules is the same as that used to braze on coaxial connectors, and is amenable to high quantity production.

Furthermore, the antenna elements can be produced to tighter tolerances than printed circuit board radiating elements. Also, because individual horns are used, they may be replaced individually as needed. In the prior art arrays that use interlocked strips of printed circuit boards for antenna elements, the entire interlocking structure must be disassembled to replace a single antenna element.

Embodiments using metallic horns for the antenna elements are also able to handle significantly more power and higher heat levels than connectorized antenna elements formed on printed circuit board material. For example, metallic horns are brazed to ceramic substrates at 750 degrees Celsius using copper-silver braze alloys. It is also estimated that the brazing is able to sustain 1500 degree Celsius temperatures before the metallic elements may become detached from the substrate. In contrast, radiating antenna elements made from printed circuit board material would become soft, delaminate, and/or deform at temperatures on the order of 200 degrees Celsius. Furthermore, designs that use antenna elements made from laminate material also typically includes soldered elements such as posts, which are subject to reflow at 180 degrees Celsius. Because of the heat limitations of antenna elements made from laminate material, designs that use the elements require cooling to maintain operating temperature for the antenna arrays, which may be difficult when the arrays are deployed in high temperature regions such as deserts. The use of metallic horns as antenna elements and brazing of the elements to the substrate removes the need for cooling of the antenna elements, although the electronic module to which the elements are coupled via the waveguides may requiring cooling. The ceramic waveguide and metal feed horns are thermally stable and do not require cooling when operated at high incident RF powers or high temperature environments Integrated Waveguide Feed The waveguide feed integrated into the substrate of an RF module couples and interfaces the circuitry of the electronics section or portion of the module with the radiating elements formed by the antenna elements attached to the substrate. The waveguide feed being integrated into the substrate permits the radiating elements to be fed without the use of connectors, and coupling of the waveguide to the radiating slotline eliminates the need for a balun circuit on the radiating element to feed the radiating horn. The waveguide feed has a lower RF loss than connector feeds.

The substrate for the RF modules is made from a high dielectric constant material. In an embodiment, the substrate may be high temperature co-fired ceramic (HTCC). A substrate with a dielectric constant of 8.8 is desirable because it provides a substrate into which a waveguide can be fabricated and matched to antenna elements. Substrates with a dielectric constant that is too high makes it difficult to match the antenna elements to the waveguide. Furthermore, while it has been observed that the dielectric constant of a homogeneous material is fairly fixed over different frequencies, the frequency at which the waveguide will operate may be a consideration when choosing the substrate material.

Figure 7:
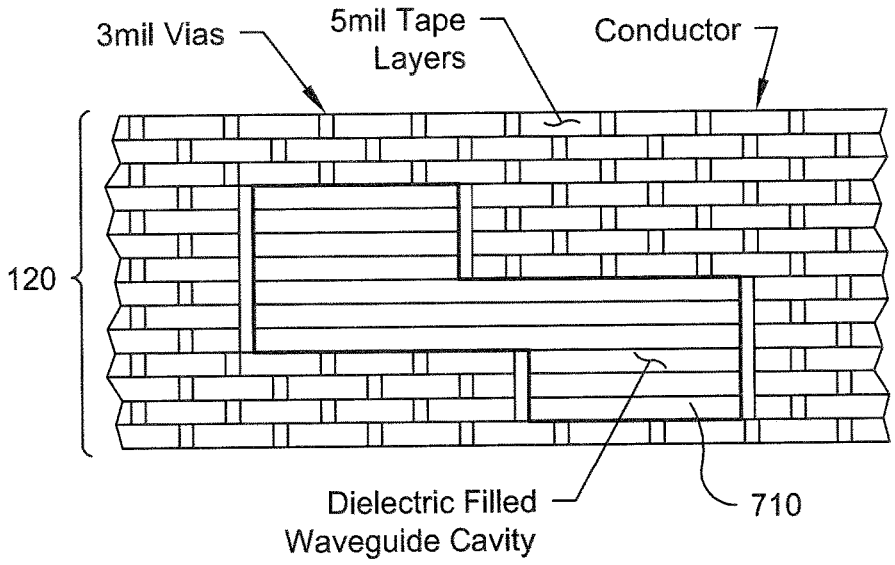
FIG. 7 is a plan view of a horizontal waveguide formed in the substrate of an RF module.
Figure 8:
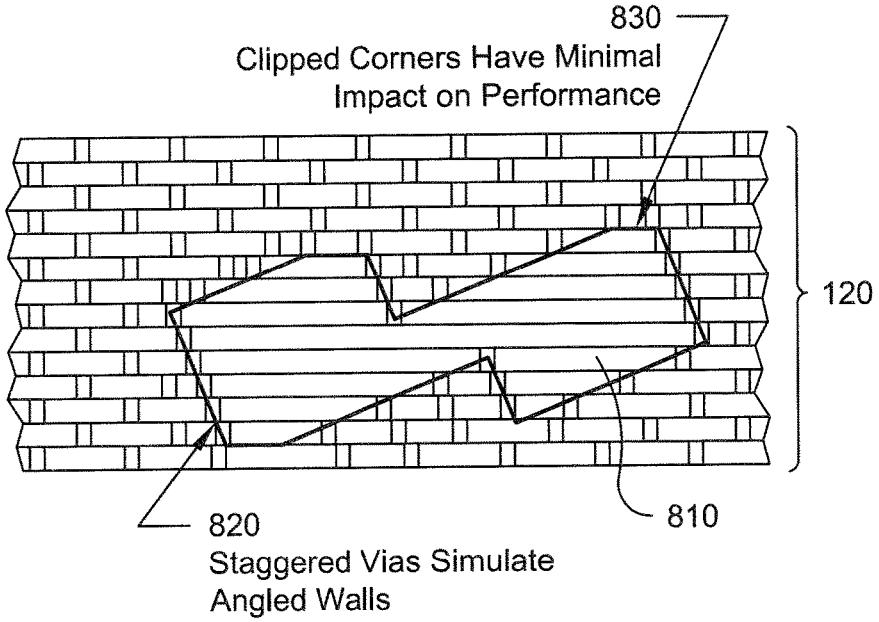
FIG. 8 is a plan view of a rotated waveguide formed in the substrate of an RF module.

In an embodiment, the waveguide E-plane is rotated 45 degrees from the module plane to accommodate the slant linear elements and to align with the element polarization. FIG. 7 shows a non-rotated waveguide 710 in substrate 120 and FIG. 8 shows a rotated waveguide 810 in substrate 120. The waveguides may be implemented in the substrate through standard fabrication techniques (e.g., standard ceramic fabrication techniques when the substrate is ceramic) using vias and circuit traces on the substrate. As shown in FIG. 8, the slanted walls 820 of the rotated waveguide 810 may be implemented using staggered vias. The implementation of alternating rotated waveguides that are orthogonal to each other permits the waveguides to fit on small RF modules such as those used for millimeter wave radar arrays. As shown in FIG. 8, the corners 830 of the rotated waveguides may be clipped to fit within tight module package constraints. The clipping is believed to have minimal effect on the performance of the waveguide. Although FIG. 8 shows particular corners that are clipped and particular corners that are not clipped, other embodiments and combinations of clipped and not clipped corners within a waveguide are possible. The clipping used within each waveguide may typically depend on the particular package into which the rotated waveguide is being fit.

Figure 9C:
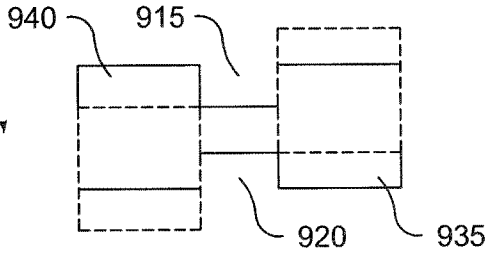
FIGS. 9A-9E are plan views of offset ridged waveguides.
Figure 9D:
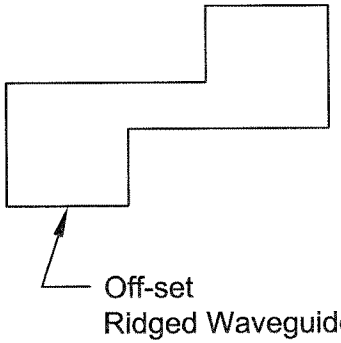
Figure 9E:
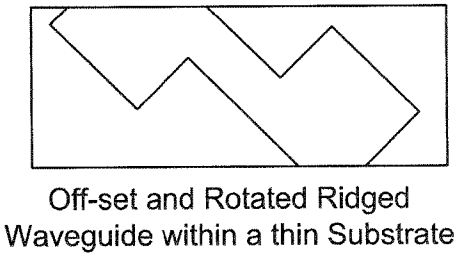
Figure 9A:
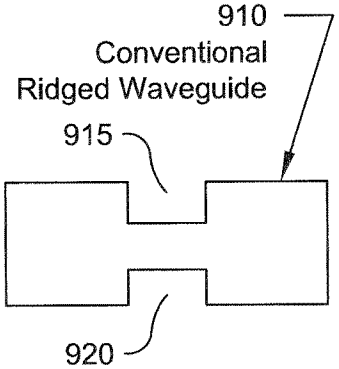
Figure 9B:
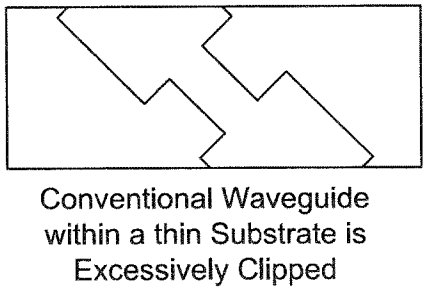

In an embodiment, the waveguide may be internally ridged to allow for broadband operation. A ridged waveguide, rather than a conventional waveguide, is used to provide broader operating bandwidth. FIGS. 9A-9E depict types of ridging that may be used in the waveguide, and as will be understood other types of ridging may be used depending on the bandwidth and frequencies desired. In general, a ridged waveguide lowers the cut-off frequency and allows for broad bandwidth. The conventional ridged waveguide 910 shown in FIG. 9A has ridges 915 and 920 in the center of the waveguide. While a conventional ridged waveguide may work in applications where the RF module substrate is large and space is not an issue, as shown in FIG. 9B a conventional waveguide is clipped extensively when it is rotated to fit within a narrow RF module 930 that has a narrow substrate, such as when a millimeter wave antenna array is being formed. Accordingly, in an embodiment shown in FIG. 9C, the ridges may be offset to maximize the waveguide dimension that can fit in the substrate footprint. Notably, the ridge offset shown in FIG. 9C is accomplished differently than in standard ridge offsets. Typically, a ridge offset would be accomplished by the offsetting the ridges 915 and 920 so they are no longer laterally coincident with each other in the waveguide. However, in the offset ridge waveguide shown in FIG. 9C, a unique method of offset is used in which the waveguides 935 and 940 are offset relative to the ridges 915 and 920, while the ridges 915 and 920 remain laterally coincident. This unique offset arrangement results in an offset ridged waveguide as shown in FIG. 9D, which better allows the waveguide to be fit onto narrow substrates when it is rotated such as in FIG. 9E (also shown in FIG. 8). Thus, the left and right halves of the ridged waveguide are offset around the centerline in order to fit the move waveguide volume within the footprint of the module, and the described offset arrangement may allow the waveguide to fit within the narrow thickness of the substrate, even when implemented in millimeter wave antenna lattices. Notably, the ridged waveguide feed is relatively insensitive to assembly tolerances typical of the braze operation which attaches the antenna element horns to the waveguide substrate Coupling of the waveguide to the antenna elements is achieved by placing the antenna elements adjacent to the waveguides as shown in FIG. 6. For example, with respect to antenna elements 510 and 520, the flared edges 512 and 522, respectively, of those antenna elements that are used to form the radiating element are placed adjacent to the slot 525 across the narrow point of the left waveguide. With respect to antenna elements 510 and 530, the flared edges 514 and 532, respectively, of those antenna elements that are used to form the radiating element are placed adjacent to the slot 535 across the narrow point of the right waveguide. In an embodiment, the antenna elements are placed to match the impedance of the waveguide and the elements that make up the radiating element. In practice, the antenna elements are typically placed so that the gap between the elements at the base of the elements is slightly smaller than the slot across the narrow point of the waveguide, which matches the impedance of the waveguide to the impedance of the radiating element. In an embodiment, the antenna element may be brazed directly to the edge of the T/R Module package in a single operation using standard alignment tooling commonly used for brazing coaxial connectors. In other embodiments in which the antenna elements are formed or made from a material not amenable to brazing, the elements may be attached to the substrate by a suitable adhesive for the operating conditions of the antenna element.

Coupling of the waveguide to the circuitry of the electrical module to which the antenna elements are attached is generally implemented using waveguide transitions to microstrip/stripline traces that interconnect with active circuitry (such as the output of a high power amplifier) in the electrical module. To achieve dual-polarized antenna elements, the feeds have to be capable of providing polarized feeds to the elements. Two embodiments that may be used to implement the waveguide feeds include: (1) the horizontal microstrip-to-waveguide feed with waveguide twist; and (2) the diagonal microstrip-to-waveguide feed. The horizontal microstrip-to-waveguide feed with waveguide twist may include a gradually rotated waveguide which includes a microstrip that transitions the electric field into the non-rotated waveguide which is subsequently twisted 45 degrees by gradually rotating the waveguide using the via and layer structure of a multi-layer RF substrate until it is aligned with the radiating horn. The diagonal microstrip-to-waveguide feed may include a microstrip with an off-set ground plane which slants the electric field prior to being introduced into a 45 degree rotated waveguide which is aligned to the radiating horn.

Figure 10:
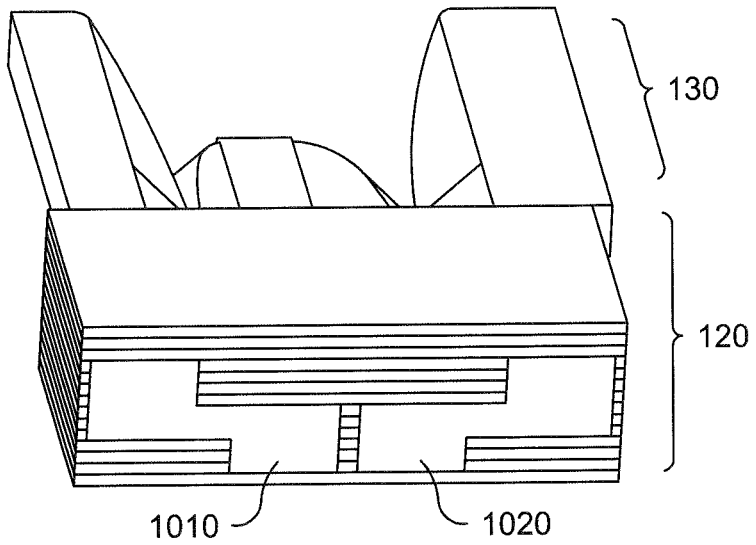
FIG. 10 is a partial isometric view of the bottom of a substrate with horizontally oriented waveguides used with a horizontal twist feed embodiment.
Figure 11:
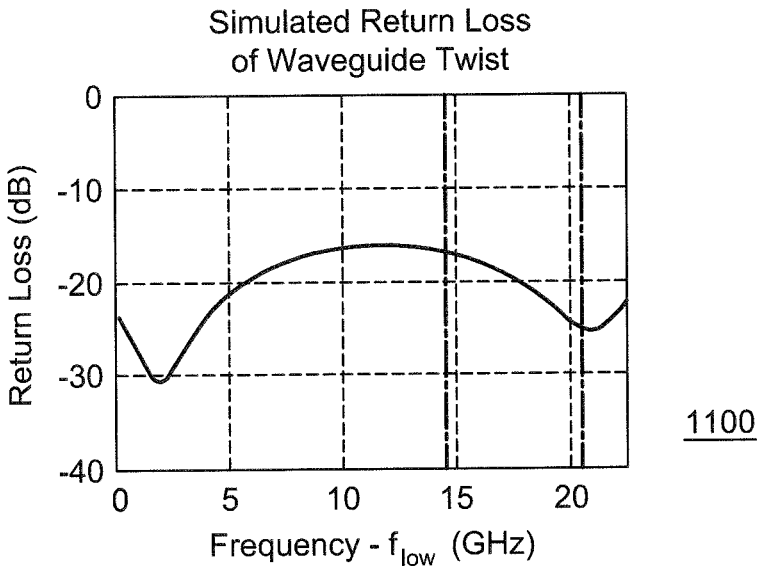
FIG. 11 is a graph of the simulated return loss of a horizontal twist feed embodiment.
Figure 13:
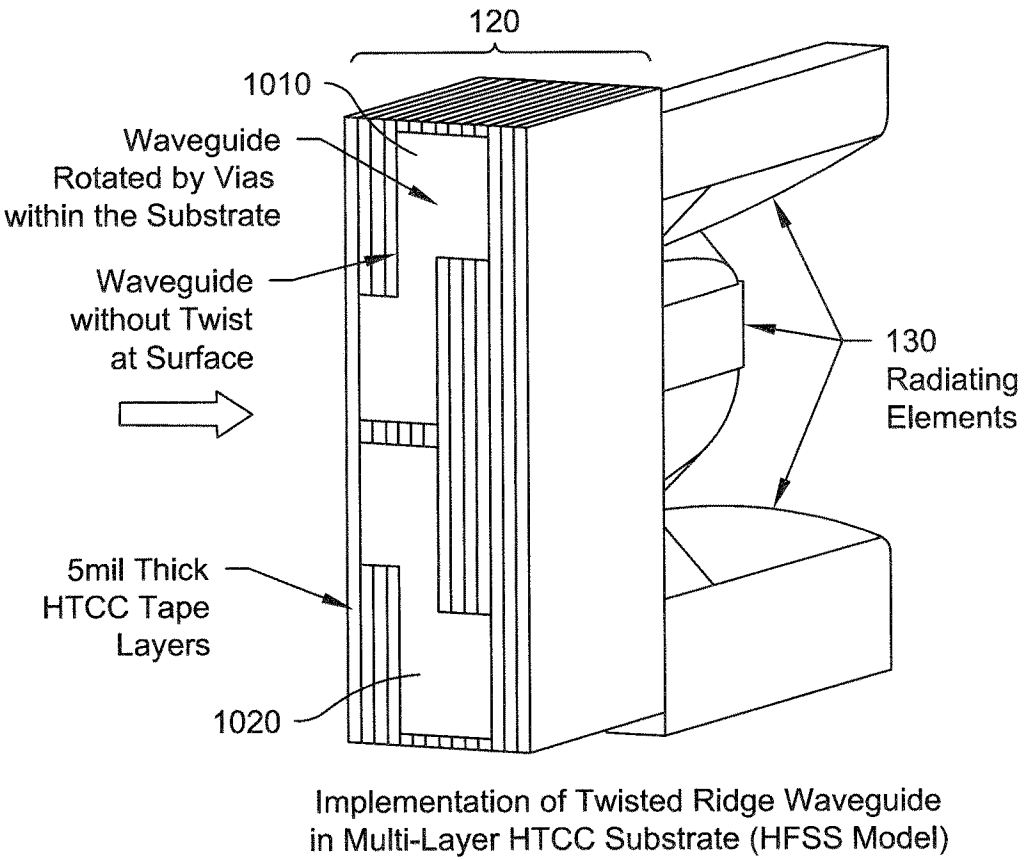
FIG. 13 is a partial isometric view of the bottom of a substrate with horizontally oriented waveguides used with a waveguide twist feed embodiment.
Figure 12:
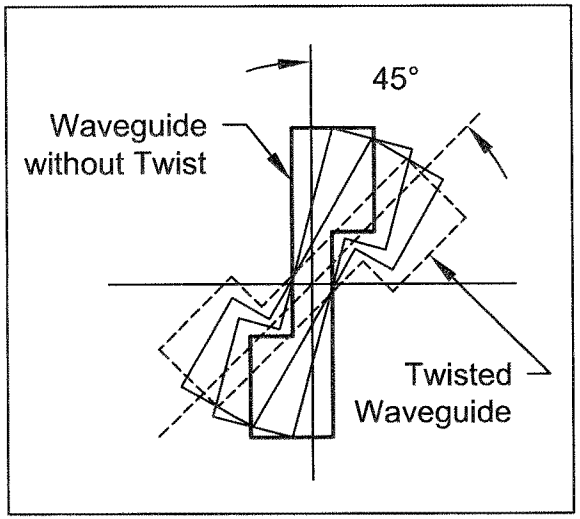
FIG. 12 is a depiction of the twisting of the waveguide in the substrate in a horizontal twist feed embodiment.

In the horizontal microstrip-to-waveguide feed with waveguide twist embodiment, at the bottom of the substrate, which contacts the electronic module, the waveguides 1010 and 1020 are horizontally-oriented as shown in the exemplary partial substrates 120 shown in FIGS. 10 and 13. A partial substrate is shown and it is understood that a substrate will typically have more waveguides, depending on the size of the RF module and the frequency of the antenna array desired. A microstrip line is used to transition from the electronic module into each of the horizontally oriented (untwisted) sections of the waveguides 1010 and 1020 at the bottom of the substrate. As will be understood, in the exemplary partial substrates 120 shown in FIGS. 10 and 13, one of the waveguides rotates +45 degrees to feed slant right and the other of the waveguides rotates −45 degrees to feed slant left. FIG. 12 depicts how the waveguide E-plane is gently rotated 45 degrees in discrete sections of the substrate from the bottom of the substrate (which contacts the electronic module) to the top of the substrate (which contacts the antenna elements). The rotation of the waveguide is accomplished through the use of staggered vias, which trace the waveguide wall. In an embodiment in which the substrate is HTCC (high temperature co-fired ceramic), a waveguide is twisted by offsetting vias in the substrate 5 mil tape layers to simulate solid ground walls, with the offsetting being done in different layers to gently and gradually rotate the waveguide 45 degrees, such as from 0 degrees to 45 degrees. As shown in the graph 1100 of FIG. 11, simulations indicate that the horizontal microstrip-to-waveguide feed has a better than 16 dB return loss. However, in certain embodiments the microstrip-to-waveguide feed is may be difficult to lay out and to fit on HPA pitch.

Figure 14:
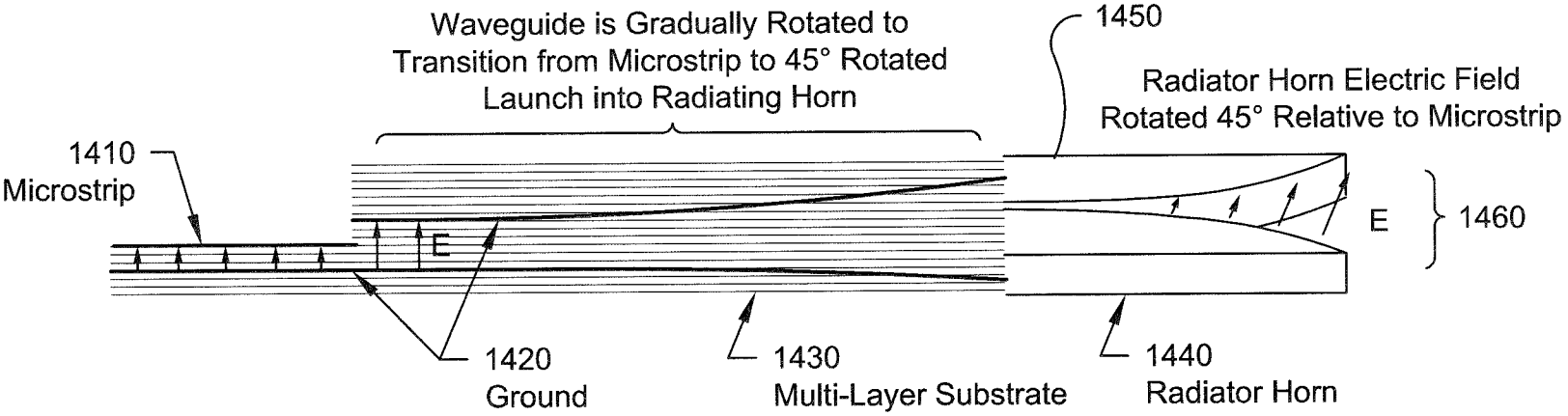
FIG. 14 is a depiction of the electric field in the waveguide twist feed embodiment.
Figure 15A:
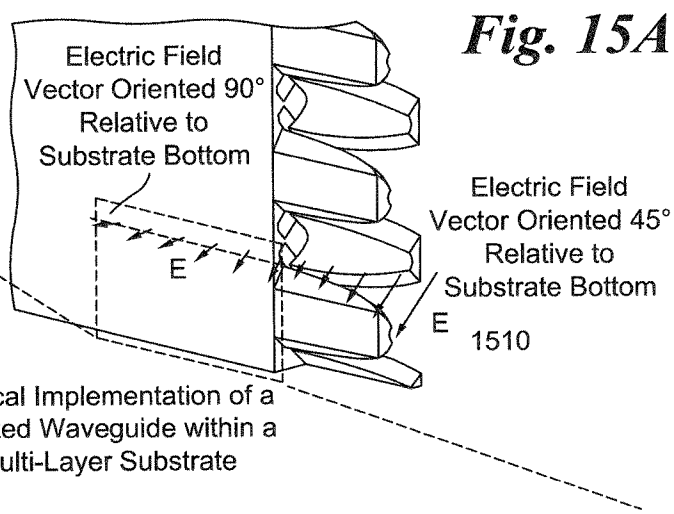
FIG. 15A is a depiction of the electric field in the substrate and at the antenna element.
Figure 15B:
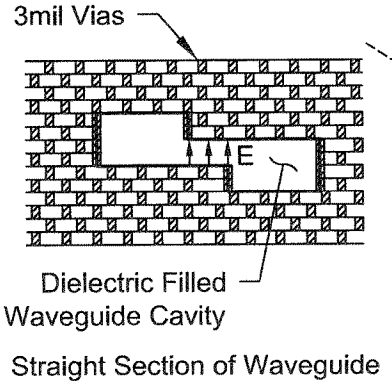
FIGS. 15B-15E depict the electric field E at different points of rotation in the waveguide twist feed embodiment.
Figure 15C:
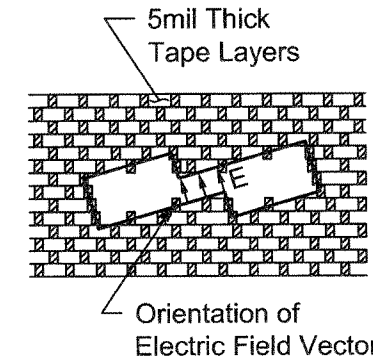
Figure 15D:
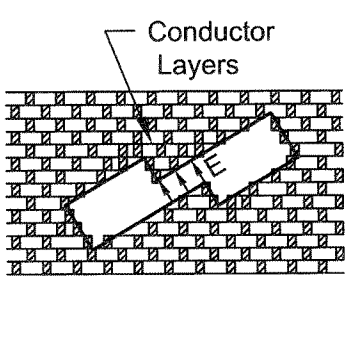
Figure 15E:
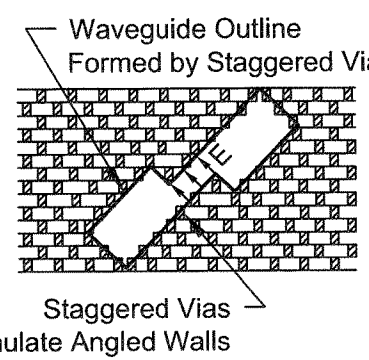
Figure 16:
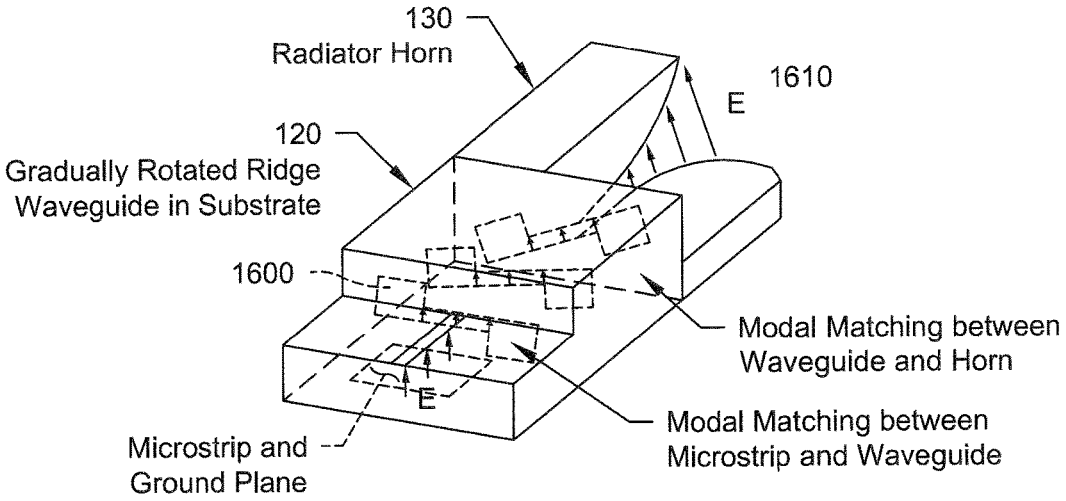
FIG. 16 is a depiction of a radiating element fed by the waveguide twist feed embodiment.

FIG. 14 depicts a representation of the electrical feed from the microstrip line from the electronic module to the radiating element, for the horizontal microstrip-to-waveguide feed with waveguide twist, and is an example of how the waveguide twist may be implemented in a co-fired ceramic layer structure. The waveguide (not shown) in the substrate 1430 is fed by a microstrip line 1410 from the electronic module. The waveguide, and thus the electric field vector, is gradually rotated 45 degrees by offsetting vias in the multi-layer structure to simulate solid ground walls which gradually rotate. The waveguide may be gradually rotated to launch into the radiating antenna element 1460 which is formed by a flared edge of antenna element 1440 and a flared edge of antenna element 1450. The electric field E is shown rotated in the radiating element 1460. FIGS. 15B-15E depict the electric field E at various stages of the rotation of the integrated waveguide, and the use of vias to simulate angled walls at different levels of the substrate as the waveguide is rotated. As shown in FIG. 15A, an electric field vector 1510 is oriented 90 degrees relative to the substrate bottom is rotated 45 relative to the substrate bottom at the radiating element. FIG. 16 also shows a representation of the horizontal microstrip-to-waveguide feed embodiment, including a representation of the electric field vector E and the microstrip and ground plane. As shown in FIG. 16, the rotation of the waveguide 1600 through the substrate, from a horizontal orientation at the bottom of the substrate, to a 45 degree rotated waveguide at the top of the substrate, rotates the electric field vector E 1610.

Figure 17:
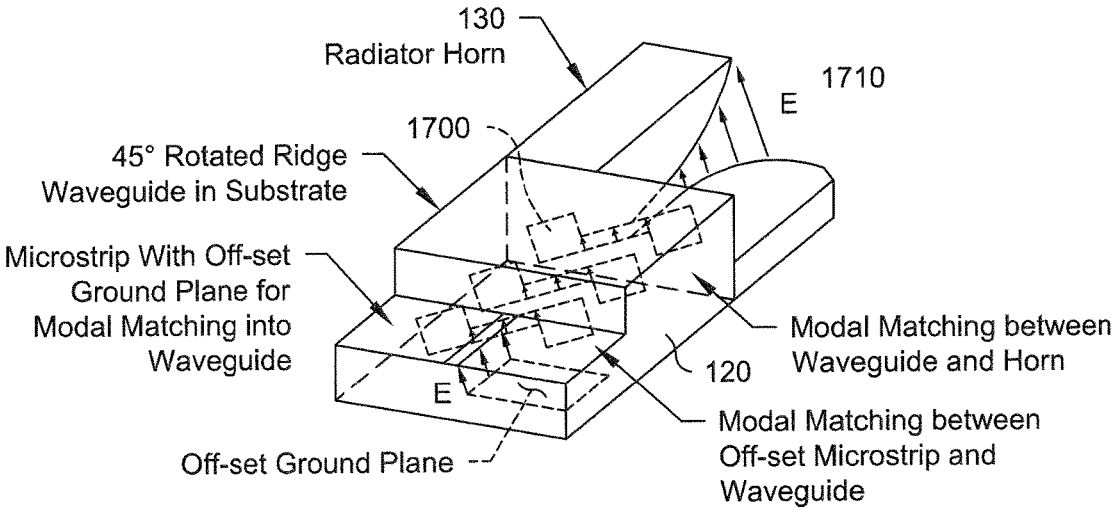
FIG. 17 is a depiction of a radiating element fed by a waveguide with a fixed rotation and offset groundplane feed embodiment.
Figure 18A:
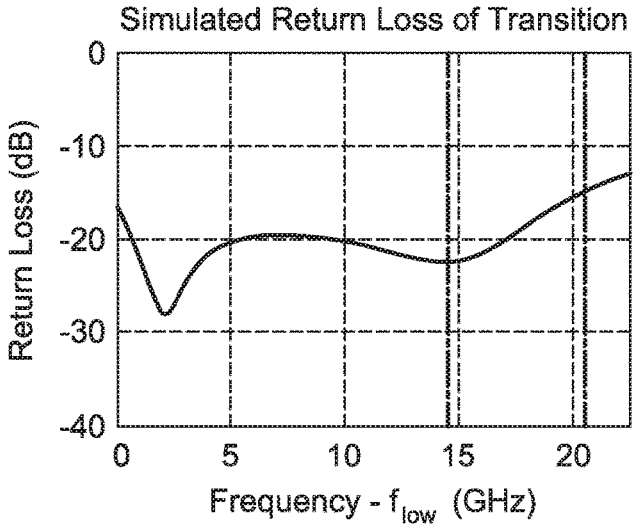
FIG. 18A is a graph of the simulated return loss of the waveguide with a fixed rotation and offset groundplane feed embodiment.
Figure 18B:
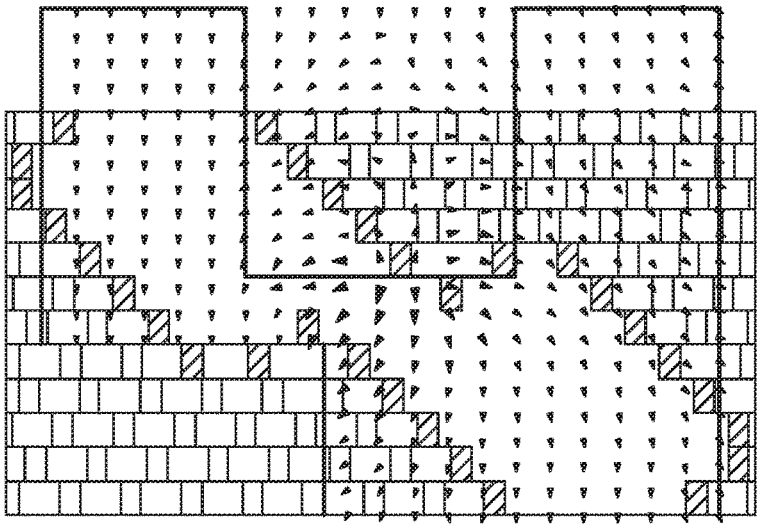
FIG. 18B is a depiction of electric fields in the waveguide with a fixed rotation and offset groundplane feed embodiment.

The diagonal microstrip-to-waveguide feed is shown in FIG. 17 and includes a microstrip line that feeds directly into a diagonally oriented waveguide 1700, which feeds straight into the antenna element 130 associated with the waveguide. In the diagonal microstrip-to-waveguide feed, the waveguide is at a fixed rotation throughout the substrate. Thus, it is rotated 45 degrees when viewed from the bottom of the substrate (which contacts the electronic module), continues through the substrate at the same rotation, and is at the same rotation when viewed from the top of the substrate where the antenna elements are attached. As shown in the embodiment of FIG. 17, a diagonally-polarized (rotated) electric field E 1710 is created by offsetting the ground plane relative to the microstrip. Dilation and line length matching may be performed in the stripline, while microstrip transition may be performed in a separate cavity. Simulations indicate that the diagonal microstrip-to-waveguide feed has a better than 13 dB return loss, which is shown in the graph 1800 of FIG. 18A. The diagonal microstrip-to-waveguide feed may be easier to implement than the horizontal microstrip-to-waveguide feed because it fits easily onto the module pitch, and is simple to lay out with the same waveguide rotation throughout the substrate. FIG. 18B is a depiction of the electric fields in the waveguide that has a fixed rotation, and which has an offset groundplane feed.

Array of RF Modules with Integrated Waveguides and Attached Antenna Elements

As will be understood, antenna arrays typically include a plurality of RF modules assembled together to form a planar array. Typically in the prior art, the RF modules contain the electronics needed for an antenna array, and the antenna elements are implemented as part of a separate structure. The antenna elements on the separate structure are then electrically connected to the RF modules using connectors attached to the antenna elements. This prior art design is difficult to implement however, because of the fragility of connectors, particular in millimeter wave arrays where the connectors may be the size of pinheads.

Figures 19A, 19B, 19C:
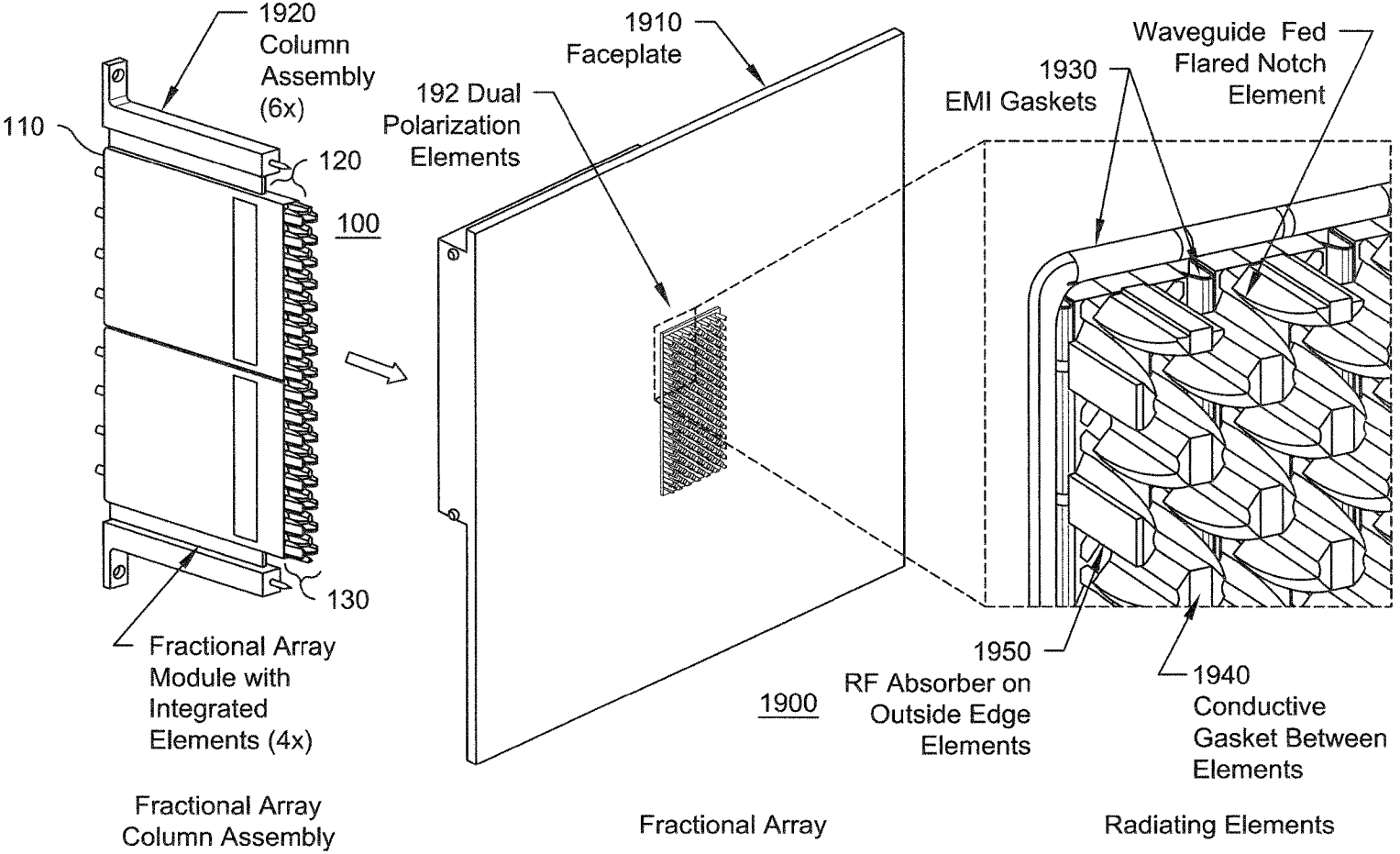
FIG. 19A is an isometric view of an antenna array.
FIG. 19B is an isometric view of a column assembly with installed RF modules having attached antenna elements used with the antenna array of FIG. 19A.
FIG. 19C is an enlargement of a section of the isometric view of an RF module with attached antenna elements of FIG. 19B.

In the embodiments of the present invention, the RF modules include antenna elements that are attached to the end of the RF modules, and integrated waveguides in a substrate of the RF modules are used to feed the antenna elements. FIG. 19A depicts a fractional antenna array 1900 with a faceplate 1910, in which the antenna array is comprised of a plurality of the disclosed RF modules 100 that have electronics 110, substrates 120 with integrated waveguides, and attached antenna elements 130. Each of the RF modules has the substrate 120 with integrated waveguides and attached antenna elements 130, and the RF modules together form an array. FIG. 19B shows an embodiment of one of the RF modules of the array, in which the RF module is mounted onto a column assembly 1920 which helps facilitate the installation of the RF module onto the array.

FIG. 19C depicts an enlargement of a section of the antenna array of FIG. 19A, which shows EMI gaskets 1930 between adjacent RF modules and between the edge of RF modules 100 and the aperture of the faceplate 1910. Conductive gaskets 1940 are also shown between individual antenna elements on adjacent RF modules to achieve connectivity between the RF modules and elements of the array. Electrical connectivity between adjacent RF modules and elements is important to maintaining proper electrical performance. Element connectivity may be achieved using EMI gaskets to bridge gaps between conductive surfaces. Connectivity between the antenna elements themselves may be achieved using a compressible foam or spiral shielding material, even where adjacent antenna elements are on different RF modules, as shown in FIG. 19C. The gaskets facilitate a connection between the element "ground", this is lower risk than the signal connections required in a connectorized design. Groundplane connectivity may be achieved using conductive spring-finger gaskets. The use of gaskets to achieve electrical continuity allows for the modules to be easily inserted or remove from the array, resultant in full maintainability. In an embodiment, radio frequency absorber may be used in the place of the foam gasket between elements, at the expense of ohmic efficiency at high scan angles. Models were run with both conductive gasket and absorber in gaps between adjacent module elements A gasket with conductivity of 2000 S/m was used in a gasket model while a cavity mode absorber was used in an absorber model. The models indicated that gasket and absorber embodiments have very similar return loss, although the absorber case has significantly higher ohmic losses.

Figure 20:
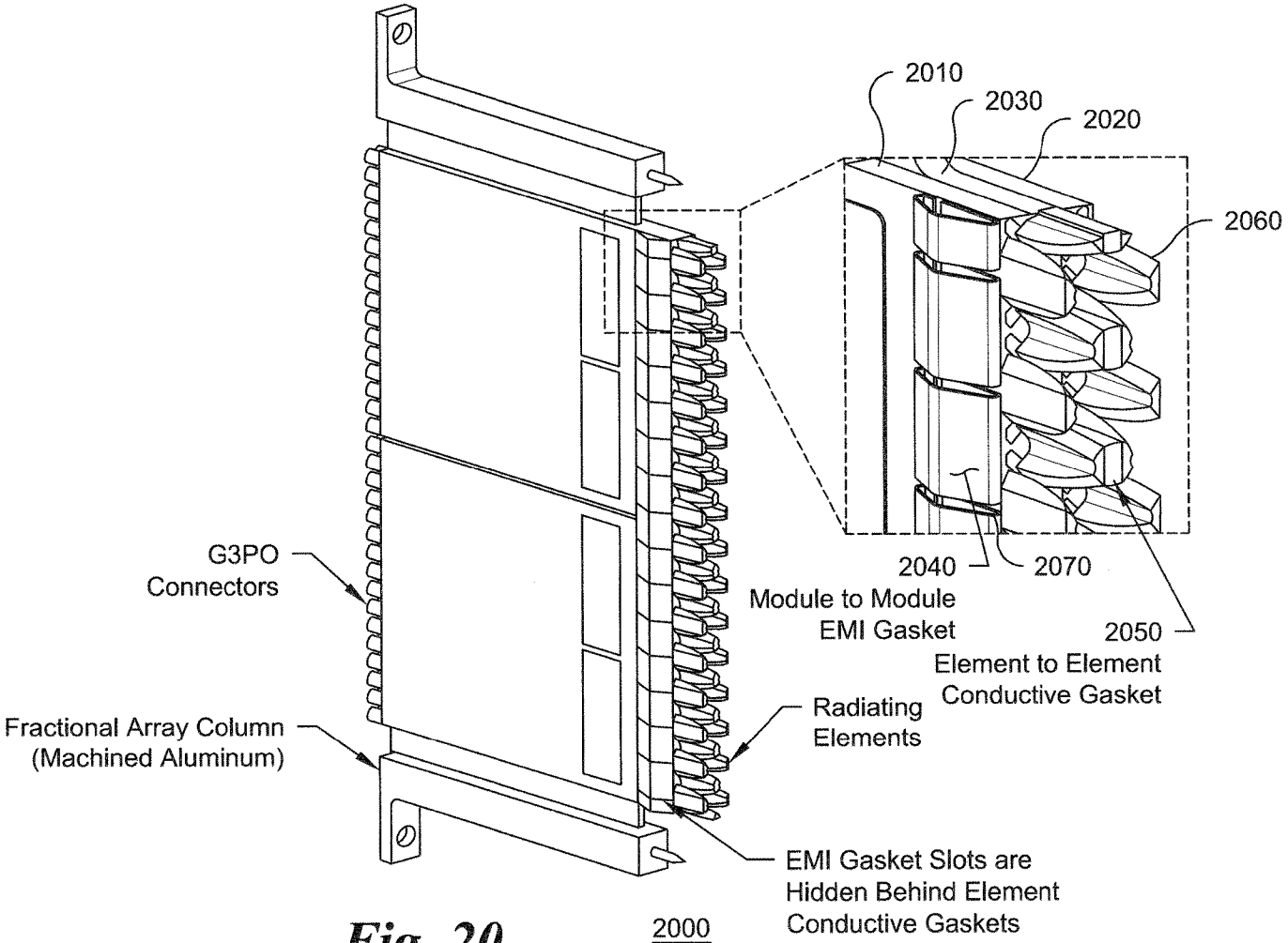
FIG. 20 is an isometric view of a column assembly with installed RF modules having attached antenna elements used with the antenna array of FIG. 19A.

FIG. 20 shows an isometric view of an embodiment in which two RF modules 2010 and 2020 with integrated waveguides and attached antenna elements, in which one RF module is mounted to either side of an array column 2030. The RF module attached to each side of the array column may be bonded to each side of the column using epoxy performs. FIG. 20 shows "module to module" EMI gaskets 2040 attached to the side of the RF module 2010, which create the electrical connection between adjacent RF modules when the modules are installed adjacent to each other. FIG. 20 also shows the conductive gasket 2050 between antenna elements 2060, which improves the elemental mutual coupling. In the embodiment shown in FIG. 20, the module to module EMI gaskets 2040 include slots 2070 which coincide with the location of the conductive gaskets 2050 between antenna elements 2060, which effectively hides the slots electrically because the conductive gaskets maintain continuity over the gap in the slots. The module to module EMI gaskets 2040 may be implemented on a side of the module that is expected to be in contact with another module, and grounds the module to its neighbor and completes the ground across the array face. The conductive gaskets 2050 also improve element mutual coupling.

Figure 21:
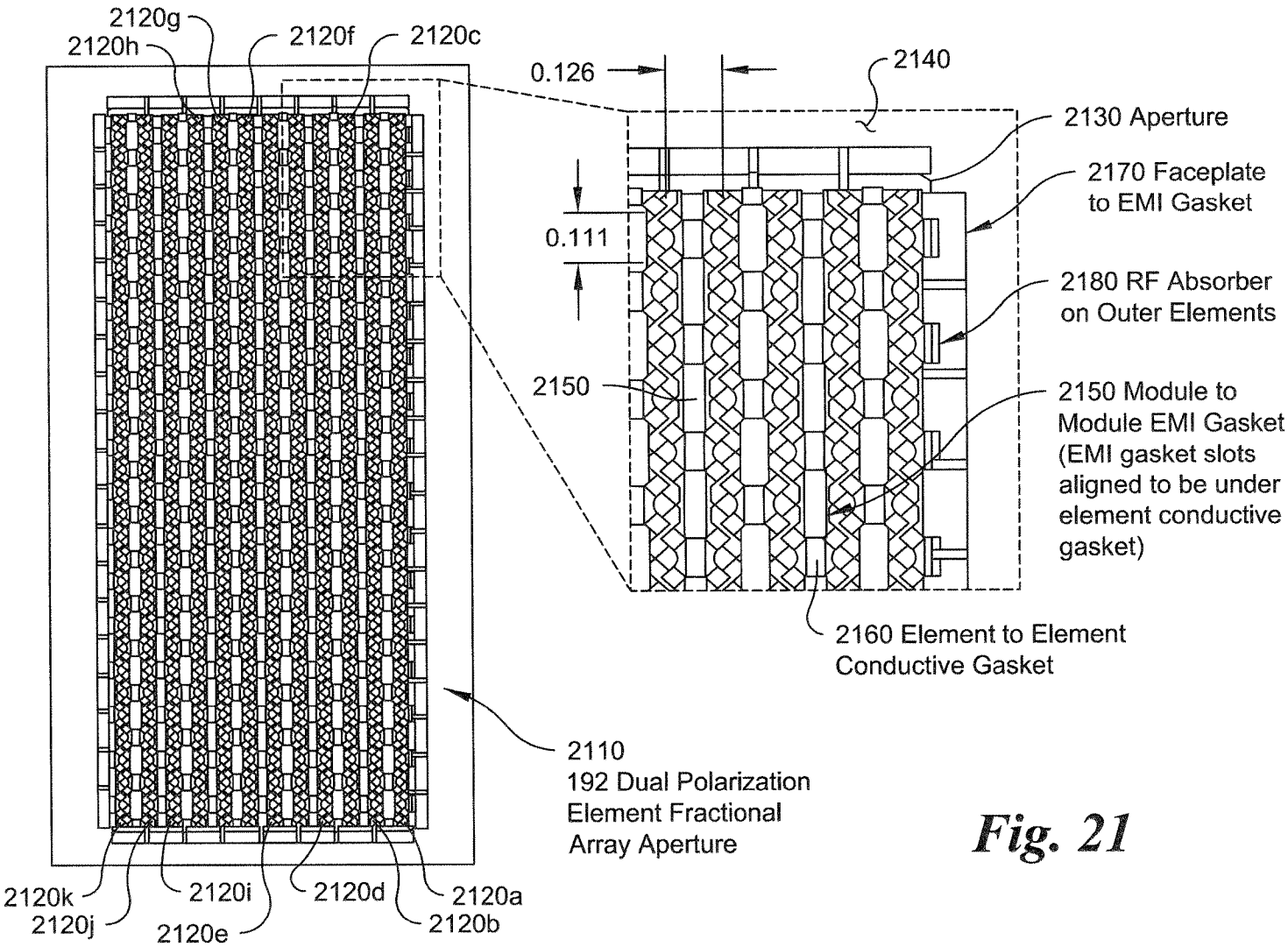
FIG. 21 is a top plan view of an array with installed RF modules and conductive gaskets.

FIG. 21 depicts a dual polarization array 2110 which shows a plurality of RF modules 2120*a*-2120*k* with attached antenna elements installed within an aperture 2130 in the faceplate 2140 of the array. FIG. 21 shows "module to module" EMI gaskets 2150 between RF modules 2120*a*-2120*k*, which create the electrical connection between adjacent RF modules. FIG. 21 also shows the conductive gaskets 2160 between antenna elements 2060, which improves the elemental mutual coupling. Also shown in FIG. 21 are faceplate to module EMI gaskets 2170, which may be located along the perimeter of the aperture opening and which may also be used to achieve electrical continuity of the groundplane throughout the array. RF Absorber 2180 may be placed on the back of the outer antenna elements along the edges of the aperture, which can help to eliminate stray or unwanted radiation. The use of gaskets to achieve electrical continuity allows for the modules to be easily inserted or remove from the array, resultant in full maintainability.

While FIG. 21 depicts one type of array which may be created using RF modules with integrated waveguides and attached antenna elements, it will be understood that other structures may also be used to create an array of such RF modules. For example, the RF modules may be configured along with other components so as to constitute a line replaceable unit (LRU) structure or module, and one or more LRUs may then be placed within a structure (such as a frame for holding LRUs) to create the antenna array. In an embodiment of the antenna array configured using LRUs, the arrangement of the antenna elements, integral waveguides, and gaskets may be similar to the array depicted in FIG. 21.

Figure 22B:
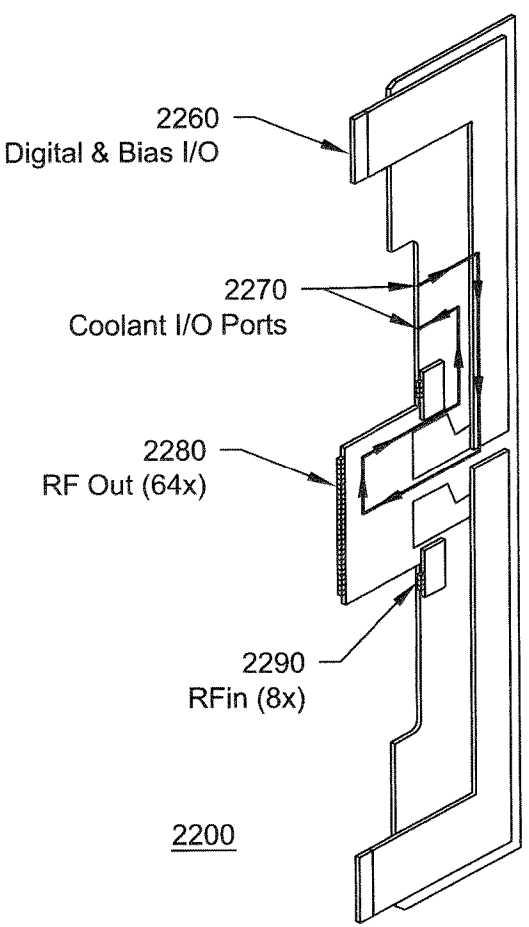
FIG. 22B is an isometric view of a second side of the LRU with installed RF modules of FIG. 22A.
Figure 22A:
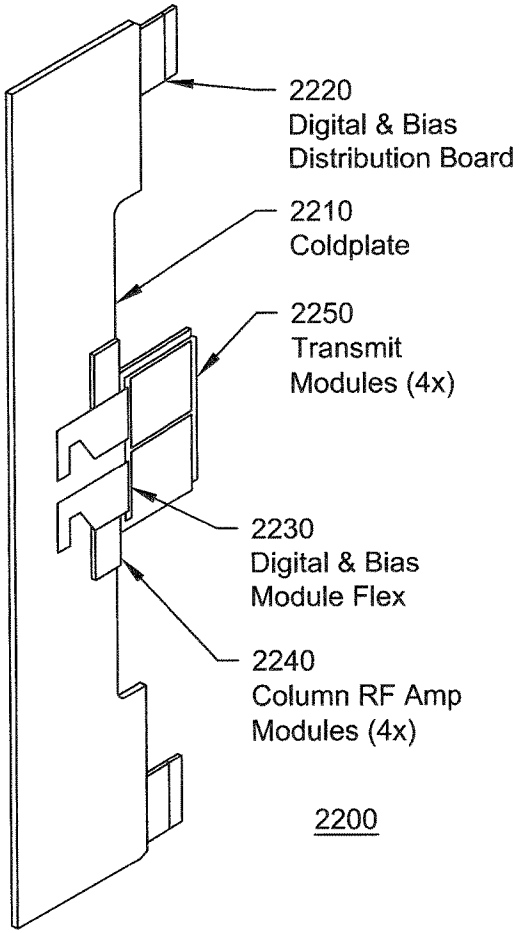
FIG. 22A is an isometric view of a first side of line replaceable unit (LRU) with installed RF modules.

FIG. 22A depicts an isometric view of a first side of an LRU with installed RF modules, which may be used to create an antenna array. An LRU may typically consist of a number of RF modules assembled to a coldplate, which provides mechanical structure. The LRU may also include flex circuits and digital control and/or power distribution boards that provide digital control and power to the LRU from a backplane in the antenna, although other types of LRUs may not have any or all of these additional elements. In an embodiment, LRU 2200 includes a coldplate, a digital & bias distribution board 2220, digital & bias module flex 2230, and four column RF amp modules (2240). In an embodiment, LRU 2200 may include 4 RF modules, in which each of the RF modules includes integrated waveguides and antenna elements attached to an end of the RF module. FIG. 22B depicts an isometric view of a second side of the LRU 2200 with installed RF modules of FIG. 22A. In an embodiment, LRU 2200 also includes the input/output (I/O) connectors for the Digital & Bias I/O 2260, coolant I/O ports 2270 for the coldplate 2210, and RF in 2290. RF Out 2280 comprise the antenna elements attached to the transmit modules 2250.

As noted, an antenna array may be created by assembling a plurality of RF modules together to form a planar array. In an embodiment, the assembly of the plurality of RF modules to form an antenna array may comprise assembling a plurality of LRU modules that have RF modules installed therein, such as the LRU of FIGS. 22A and 22B. In the embodiments of the present invention, the RF modules installed in the LRUs include antenna elements that are attached to the end of the RF modules, and integrated waveguides in a substrate of the RF modules are used to feed the antenna elements. One or more RF modules may be attached or connected to each LRU as shown in FIGS. 22A and 22B, wherein each LRU has 4 RF modules on it, in a 2×2 arrangement of the RF modules. In an embodiment, the LRU may have structural provisions for receiving the RF modules, such as mounting holes for fastening a column to the LRU on which the RF modules are mounted, as shown in FIG. 20. The LRU may have other types of structural provisions for receiving RF modules, such as one or more slots for receiving and holding one or more RF modules. In an embodiment, the antenna array may have a frame or structure for receiving the LRUs, and may also include a faceplate which includes an aperture defined therein, through which the RF modules on the LRUs extend so that they may transmit or receive signals.

The embodiments of the RF with integrated waveguide and attached antenna elements disclosed have significant advantages over the prior art antenna arrays, particular those which use antenna elements made from laminate materials which require connectors to connect them to the RF modules. First, the disclosed RF module embodiments are a much lower cost solution than prior art designs and assembly of the RF module embodiments is greatly simplified over prior art designs. Material cost is significantly reduced by eliminating etched dielectric circuits, solder attached connectors, support posts and a ground plate which contains many tightly toleranced machined features. Assembly cost is reduced by eliminating solder attach of coax connectors to dielectric radiator circuits and hand placement of radiators and support posts into a ground plate followed by solder reflow of the entire assembly. The machined or formed antenna elements can be produced at a significantly lower cost than connectorized elements and because the element parts are machined using standard techniques, the cost of the entire element will be on par with that of a single microwave connector. Additionally, the technique used to braze the elements onto the modules is the same as that used to braze on coaxial connectors, is amenable to high quantity production, and cost of brazing is similar to the cost of brazing connectors. The only portion of the element fabrication that will require significant manual labor would be the addition of the conducive gaskets; however, this process is nevertheless much less labor intensive than the assembly of egg-crate arrays taught by the prior art. The waveguide feeds are created using ceramic manufacturing processes, providing a significant improvement in the producibility/reliability of connections between the electronic modules and the antenna elements. Further, because the waveguides remove the need for connectors for each antenna element, the risk of blind mating to multiple RF connectors is removed and next higher assembly complexity is reduced by eliminating blind mate connector sets and their associated tight alignment tolerances required to insure proper operation. Also, unlike prior art designs that are based on laminate material antenna elements, the disclosed embodiments of the invention are fully scalable and readily maintainable.

The embodiments of the RF module with integrated waveguide and attached antenna elements disclosed also have the advantage that they are inherently a lower loss design than prior art antenna arrays using connectorized antenna elements made from laminate material. The waveguide feed design has lower ohmic loss than a stripline feed associated with antenna elements made from laminate material. In fact, the waveguide design rejects low frequency interference and effectively acts as a high-pass filter, which strongly attenuates singles coupled from low frequency emitters. The machined element exhibits lower losses than a laminate element due to its lack of a dielectric substrate and larger current carrying areas. Additionally, the integrated element has no connector which eliminates a significant amount of ohmic loss, and its waveguide feed has lower ohmic losses than the stripline feed of the conventional element. Finally, since the integrated element is manufactured using a ceramic feed and a machined horn made from a low expansion alloy with a high melting point, it is inherently able to handle more power without the need for cooling the element which is required. In fact, the ceramic waveguide feed coupled with an air dielectric metal horn are limited in RF power handling only by the breakdown voltage of the air gap between the feed horns A RF module including an integrated waveguide feed and attached antenna elements may be fabricated by providing a RF module including an end substrate, forming integral orthogonal waveguides in the substrate, electrically coupling the waveguide to the circuitry of the RF module, and attaching antenna elements to the substrate to form radiating elements centered about the waveguides. As noted, the substrate may be a high temperature co-fired ceramic and the waveguides may be formed using standard ceramic fabrication techniques. The antenna elements may be a machined metal such as a vacuum melted, iron-nickel-cobalt, low expansion alloy with uniform expansion properties and a high melting point, or may be a formed piece. The antenna elements may be brazed onto the ceramic substrate or attached with a suitable adhesive such as an epoxy. The waveguide may be electrically coupled to the circuitry of the RF module by feeding a microstrip from the RF module to the waveguide, such as by a (1) Horizontal microstrip-to-waveguide feed, with a waveguide twist, or by (2) an HPA output microstrip line feeding into a rotated waveguide.

An entire antenna array may also be fabricated within an aperture defined in a faceplate. First, a plurality of RF modules may be fabricated, each of the RF module including an integrated waveguide feed and attached antenna elements. Then electrically conductive gaskets may be attached to the sides of the RF modules that will contact other RF modules in the array. Then, in an embodiment, one or more RF modules can then be attached to an LRU module or to a frame that is used to attach the RF module to the LRU module. The LRU module may then be installed within an array such as in a structural frame behind the faceplate of the antenna array. The frame may be designed to hold a plurality of LRU modules and to electrically connect the RF modules to next higher assemblies. After the necessary number of RF modules are fabricated and installed on LRUs, each LRU may be installed into the aperture of the faceplate into the frame for the RF modules.

After, or before, the RF modules are installed, electrical gaskets may be installed as needed to maintain electrical continuity over the antenna array. In particular, gaskets may be installed between the ends and sides of RF modules that are adjacent to the aperture in the faceplate, to maintain electrical continuity between the RF modules and the faceplate. Also, gaskets are installed between antenna elements that are adjacent to each other but which are on different RF modules. In an embodiment, RF absorber may be placed on the back (the non-flared side) of antenna elements whose non-flared sides are facing outward from the array to the faceplate.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. An radio frequency (RF) module for an array antenna comprising:

(a) a substrate including a plurality of integral waveguides formed therein, each of the plurality of integral waveguides being orthogonally-oriented with respect to its adjacent waveguides; and (b) a plurality of antenna radiator elements attached to the substrate and oriented such that a pair of the plurality of antenna radiator elements is electrically coupled to one of the plurality of integral waveguides, the plurality of integral waveguides and their corresponding pairs of antenna radiator elements forming dual-polarized antenna radiator elements;

wherein each of the plurality of integral waveguides is electrically coupled to electrical circuitry of the RF module, and wherein each of the plurality of integral waveguides has a horizontal orientation at a bottom of the substrate and a rotated orientation at a top of the substrate.

2. The RF module of claim 1, wherein the substrate is ceramic.

3. The RF module of claim 2, wherein each of the plurality of antenna radiator elements is metallic.

4. The RF module of claim 3, wherein each of the plurality of metallic antenna radiator elements is machined.

5. The RF module of claim 3, wherein each of the plurality of metallic antenna radiator elements is attached onto the ceramic substrate by a braze.

6. The RF module of claim 1, wherein each of the plurality of antenna radiator elements is attached to the top of the substrate, and wherein each of the plurality of integral waveguides is electrically coupled to the electrical circuitry of the RF module by a horizontal microstrip line.

7. An antenna radar array comprising:

a faceplate having an aperture defined therein;

a plurality of RF modules adjacently arranged within the aperture, each of the plurality of RF modules including:

(a) a substrate including a plurality of integral waveguides formed therein, each of the plurality of integral waveguides being orthogonally-oriented with respect to its adjacent integral waveguides; and (b) a plurality of antenna radiator elements attached to the substrate and oriented such that a pair of the plurality of antenna radiator elements is electrically coupled to one of the plurality of waveguides, the plurality of waveguides and their corresponding pairs of antenna radiator elements forming dual-polarized antenna radiator elements, wherein each of the integral waveguides is electrically coupled to electrical circuitry of its corresponding RF module, and wherein each of the plurality of integral waveguides has a first orientation at a bottom of the substrate and a second orientation, distinct from the first orientation, at a top of the substrate.

8. The antenna radar array of claim 7, further comprising module-to-module electrically conductive gaskets between ones of the plurality of RF modules that are adjacent to other ones of the plurality of RF modules.

9. The antenna radar array of claim 7, further comprising element-to-element electrically conductive gaskets between ones of the plurality antenna radiator elements on an RF module that are adjacent to other ones of the plurality of antenna radiator elements on an adjacent RF module.

10. The antenna radar array of claim 7, further comprising faceplate-to-module electrically conductive gaskets between the faceplate and the ones of the plurality of RF modules that are adjacent to the faceplate.

11. The antenna radar array of claim 7, wherein the substrate on each of the plurality of RF modules is ceramic.

12. The antenna radar array of claim 7, wherein each of the plurality of antenna radiator elements on each of the plurality of RF modules is metallic.

13. The antenna radar array of claim 12, wherein each of the plurality of antenna metallic radiator elements is attached onto the substrate of one of the plurality of RF modules by a braze.

14. The antenna radar array of claim 7, wherein each of the plurality of antenna radiator elements is attached onto the top of the substrate, wherein each of the plurality of integral waveguides has a horizontal orientation at a bottom of the substrate and a rotated orientation at the top of the substrate, and wherein each of the plurality of integral waveguides is electrically coupled to the electrical circuitry of its corresponding RF module by a horizontal microstrip line.

15. The antenna radar array of claim 7, wherein each of the plurality of RF modules is attached to one of a plurality of line replaceable unit (LRU) modules, and wherein the plurality of LRU modules are adjacently arranged within the aperture of the faceplate of the antenna radar array.

16. A method for fabricating a radio frequency (RF) module for an array antenna comprising:

forming a substrate including a plurality of integral waveguides by:

forming a plurality of substrate layers;

forming a plurality of vias through each of the plurality of substrate layers; and stacking the plurality of substrate layers such that the plurality of vias define the plurality of integral waveguides, wherein each of the plurality of integral waveguides is orthogonally-oriented with respect to its adjacent integral waveguides;

attaching the RF module to the substrate;

electrically coupling each of the plurality of integral waveguides to circuitry of the RF module, and wherein each of the plurality of waveguides has a first orientation at a bottom of the substrate and a second orientation distinct from the first orientation, at a top of the substrate;

and attaching a pair of antenna elements to the top of the substrate about each of the plurality of integral waveguides to form a pair of radiating antenna elements centered about each of the plurality of integral waveguides, the plurality of integral waveguides and theft corresponding pairs of antenna radiator elements forming dual-polarized antenna radiator elements.

17. The method of claim 16, wherein attaching each pair of antenna elements to the substrate comprises brazing each pair of antenna elements to the substrate.

18. The method of claim 16, wherein each of the plurality of integral waveguides has a horizontal orientation at the bottom of the substrate and then rotates through the substrate so that the integral waveguides have a 45 degree rotated orientation at the top of the substrate.

19. The method of claim 16, further comprising:

forming an offset ground plane in each of the plurality of integral waveguides, and wherein electrically coupling each of the plurality of integral waveguides to the circuitry of the RF module comprises electrically coupling each of the plurality of integral waveguides to an amplifier output microstrip line feed into each of the plurality of integral waveguides.

20. The method of claim 16, wherein the step of forming a plurality of vias through each of the plurality of substrate layers further comprises:

forming at least a first one of the plurality of vias defining a first one of the plurality of integral waveguides with a first angular orientation; and forming at least another one of the plurality of vias defining the first one of the plurality of integral waveguides with a second angular orientation, distinct from the first angular orientation.

* * * * *